US009616277B2

(12) United States Patent
Ushikubo et al.

(10) Patent No.: US 9,616,277 B2
(45) Date of Patent: Apr. 11, 2017

(54) EXERCISE ASSISTING DEVICE

(71) Applicant: FUCOM CO., LTD., Osaka-shi (JP)

(72) Inventors: Fumio Ushikubo, Osaka (JP); Shigeaki Kimoto, Osaka (JP); Yoshiaki Iida, Moriguchi (JP)

(73) Assignee: FUCOM CO., LTD., Osaka (JP)

( * ) Notice: Subject to any disclaimer, the term of this patent is extended or adjusted under 35 U.S.C. 154(b) by 272 days.

(21) Appl. No.: 14/373,749

(22) PCT Filed: Nov. 9, 2012

(86) PCT No.: PCT/JP2012/007194
§ 371 (c)(1),
(2) Date: Jul. 8, 2015

(87) PCT Pub. No.: WO2013/124930
PCT Pub. Date: Aug. 29, 2013

(65) Prior Publication Data
US 2015/0306450 A1 Oct. 29, 2015

(30) Foreign Application Priority Data
Feb. 24, 2012 (JP) ..... 2012-039408

(51) Int. Cl.
*A63B 22/00* (2006.01)
*A63B 23/02* (2006.01)
(Continued)

(52) U.S. Cl.
CPC .... *A63B 22/0015* (2013.01); *A63B 21/00072* (2013.01); *A63B 21/1465* (2013.01);
(Continued)

(58) Field of Classification Search
CPC ..... A63B 21/00058; A63B 21/0069; A63B 21/00072; A63B 21/00076;
(Continued)

(56) References Cited

U.S. PATENT DOCUMENTS 4,176,836 A * 12/1979 Coyle ..... A63B 21/0622 482/96
4,709,918 A * 12/1987 Grinblat ..... A63B 21/012 482/118
(Continued)

FOREIGN PATENT DOCUMENTS

CA 2242952 A 7/1997
JP 07-75682 A 3/1995
(Continued)

OTHER PUBLICATIONS

International Search Report mailed Feb. 26, 2013 for the corresponding PCT Application No. PCT/JP2012/007194.
(Continued)

*Primary Examiner* — Loan H Thanh
*Assistant Examiner* — Gary D Urbiel Goldner
(74) *Attorney, Agent, or Firm* — Leason Ellis LLP

(57) ABSTRACT

An exercise assisting device includes a table shape body configured for a user to step on, a main body which supports the table shape body from below, and a hold body which is arranged on the main body. The hold body is configured to hold a trunk of the user as the user steps on the table shape body and a center of gravity of the user is positioned more forward of a step position provided on the table shape body. The exercise assisting device is configured to move the table shape body relative to the main body and/or the hold body relative to the main body while regulating a forward inclination of the user as the user uses the device.

7 Claims, 12 Drawing Sheets

(51) Int. Cl.
*A63B 23/04* (2006.01)
*A63B 69/00* (2006.01)
*A63B 22/20* (2006.01)
*A63B 21/00* (2006.01)

(52) U.S. Cl.
CPC ..... *A63B 21/4007* (2015.10); *A63B 22/203* (2013.01); *A63B 22/205* (2013.01); *A63B 22/208* (2013.01); *A63B 23/02* (2013.01); *A63B 23/04* (2013.01); *A63B 69/0028* (2013.01); *A63B 69/0057* (2013.01); *A63B 2022/0017* (2013.01); *A63B 2022/206* (2013.01); *A63B 2225/09* (2013.01)

(58) Field of Classification Search
CPC ..... A63B 21/00185; A63B 21/008; A63B 21/0083; A63B 21/0085; A63B 21/0087; A63B 21/068; A63B 21/15; A63B 21/159; A63B 21/4007; A63B 21/4027; A63B 21/4029; A63B 21/4031; A63B 21/4033; A63B 21/4034; A63B 21/4039; A63B 21/4045; A63B 21/4047; A63B 22/0015; A63B 22/0017; A63B 22/0046; A63B 22/0048; A63B 22/0056; A63B 22/04; A63B 22/14; A63B 22/16; A63B 22/18; A63B 22/20; A63B 22/201; A63B 22/203; A63B 22/205; A63B 22/208; A63B 2022/002; A63B 2022/185; A63B 2022/206; A63B 23/02; A63B 23/0205; A63B 23/0211; A63B 23/0216; A63B 23/0222; A63B 23/04; A63B 23/0405; A63B 23/0417; A63B 23/047; A63B 23/0482; A63B 23/0494; A63B 26/00; A63B 26/003; A63B 69/0028; A63B 69/0035; A63B 69/0057; A63B 69/0059; A63B 69/0064; A63B 2069/0031; A63B 2069/0037; A63B 71/0054; A63B 2071/0063; A63B 2071/0072; A63B 2071/0081; A63B 2071/009; A63B 2208/02; A63B 2208/0204; A63B 2208/0209; A63B 2225/09; A63B 2225/093; A63B 2225/096
See application file for complete search history.

(56) References Cited

U.S. PATENT DOCUMENTS 4,781,372 A * 11/1988 McCormack .... A63B 23/03533 482/104
4,867,443 A * 9/1989 Jensen ..... A63B 69/182 434/253
4,915,373 A 4/1990 Walker
4,915,378 A 4/1990 Abrahamian et al.
4,960,276 A * 10/1990 Feuer ..... A63B 21/157 482/4
5,031,898 A 7/1991 Anthony
5,226,866 A * 7/1993 Engel ..... A63B 21/015 482/52
5,234,392 A * 8/1993 Clark ..... A63B 69/0035 482/112
5,338,273 A * 8/1994 Metcalf ..... A63B 22/0012 482/51
5,342,264 A * 8/1994 Gordon ..... A63B 21/018 482/51
5,383,831 A * 1/1995 Drath ..... A63B 23/0405 482/101
5,387,168 A * 2/1995 Bostic ..... A63B 69/182 482/139
5,401,226 A * 3/1995 Stearns ..... A63B 21/00178 482/51
5,429,563 A * 7/1995 Engel ..... A63B 21/015 482/51
D364,662 S * 11/1995 Camfield ..... D21/668
D375,767 S * 11/1996 Camfield ..... D21/668
5,656,003 A * 8/1997 Robinson ..... A63B 23/03525 482/100
5,695,433 A * 12/1997 Buisman ..... A63B 22/0012 482/70
D393,027 S * 3/1998 Chen ..... D21/670
5,733,226 A * 3/1998 Chen ..... A63B 22/001 482/51
5,941,804 A * 8/1999 Johnston ..... A63B 21/0615 482/134
5,971,892 A * 10/1999 Lee ..... A63B 22/001 482/51
6,454,679 B1 * 9/2002 Radow ..... A63B 22/0235 482/4
6,676,569 B1 * 1/2004 Radow ..... A63B 22/0235 482/4
8,083,655 B2 * 12/2011 Hoebel ..... A61H 3/008 482/121
8,241,188 B2 * 8/2012 Robinson ..... A63B 22/02 473/441
8,444,533 B2 * 5/2013 Robinson ..... A63B 22/02 434/251
2003/0232703 A1 * 12/2003 Webber ..... A63B 21/068 482/95
2004/0009855 A1 * 1/2004 Webber ..... A63B 21/068 482/94
2004/0167000 A1 * 8/2004 Schwarz ..... A63B 23/0417 482/123
2004/0209751 A1 * 10/2004 Thonn, Jr. ..... A63B 21/00072 482/140
2005/0079956 A1 4/2005 Bruno
2006/0229170 A1 * 10/2006 Ozawa ..... A61H 1/003 482/92
2013/0079200 A1 * 3/2013 Rahimi ..... A61H 1/0255 482/62
2014/0011645 A1 * 1/2014 Johnson ..... A63B 21/4033 482/121

FOREIGN PATENT DOCUMENTS

JP 09-154989 A 6/1997
JP 2002-17887 A 1/2002
JP 2002-78817 A 3/2002
JP 3465044 B 11/2003
JP 2004-81576 A 3/2004
JP 2004-147908 A 5/2004
JP 2004-187724 A 7/2004
JP 2005-58733 A 3/2005
JP 3673805 B 7/2005
JP 2005-245638 A 9/2005
JP 2006-6419 A 1/2006
JP 2006-340746 A 12/2006
JP 2006-340747 A 12/2006
JP 2007-252894 A 10/2007
JP 4478208 B 6/2010
JP 2011-125728 A 6/2011
WO WO-2004/112912 A 12/2004
WO WO-2005/099648 A 10/2005

OTHER PUBLICATIONS

European Search Report mailed Sep. 22, 2015 for the corresponding European Patent Application No. 12869099.7.

* cited by examiner

EXERCISE ASSISTING DEVICE

CROSS-REFERENCE TO RELATED PATENT APPLICATIONS

This application is a U.S. National Phase Application under 35 U.S.C. §371 of International Patent Application No. PCT/JP2012/007194, filed Nov. 9, 2012, and claims the benefit of Japanese Patent Application No. 2012-039408, filed on Feb. 24, 2012, all of which are incorporated by reference in their entirety herein. The International Application was published in Japanese on Aug. 29, 2013 as International Publication No. WO/2013/124930 under PCT Article 21(2).

FIELD OF THE INVENTION

A present invention relates to an exercise assisting device which is suitable for a training of the center of gravity movement at a time of stepping on in running or walking et cetera.

BACKGROUND OF THE INVENTION

Generally, for health maintenance (improvement of lifestyle-related diseases) or enhancement of athletic abilities, it is valid to decrease body fats and promote carbohydrate metabolism by aerobic exercises. That is to say, if we incorporate glucoses which are energy sources of muscles into the muscles and burn the glucoses, we consume surplus glucoses, as a result of improvement of hyperglycemia and hyperinsulinemia, incorporating the glucoses and burning the glucoses contribute the improvement of lifestyle-related diseases (diabetes, obesity and hyperlipemia and so on).

The incorporating the surplus glucoses into the muscles is caused by muscle contractions, if we increase incorporated quantity into the muscles, it becomes possible to promote the carbohydrate metabolism.

In order to do the carbohydrate metabolism effectively by the muscle contractions, it is desirable to cause the muscle contractions of large volume muscles, we think that it is valid to extend and bend a hip joint and contract a big muscle group from a trunk to femoral regions.

There are running or walking et cetera as exercises contracting the big muscle group, and in the capacity of a device to imitate those exercises, treadmill is generally known.

The treadmill is an exercise assisting device to be capable of adapting rotational velocity and inclination angle of a moving belt which is a walking surface or running surface. And, as an aim of a training of a whole body endurance, running exercise or walking exercise on the treadmill are often done.

On the other hand, in the capacity of an exercise assisting device which is different from the treadmill and which intend a simulation of running or walking, it is known that an axle moving type bicycle ergometer which is disclosed in Japanese Patent Application Laid Open No. 2002-78817.

The ergometer comprises a pair of rotational axes which are given each rotational force by a pair of right and left pedals and a pair of right and left arms, a pair of tables which supports each axis of the pair of rotational axes in a horizontal direction, a pair of guide parts which supports each table of the pair of tables capably of reciprocating in a direction orthogonal to the pair of rotational axes, a pair of moving mechanisms which move the pair of tables on the pair of guide parts based on rotational angle of the rotational axis and a braking mechanism which do a breaking of each rotational axis of the pair of rotational axes (refer to Japanese Patent Application Laid Open No. 2002-78817).

Problem to be Solved

However, there is a following problem the in above-mentioned conventional exercise assisting device.

Though the treadmill, apparently, looks like a user runs, actually the user just jumps obliquely forward and upward, even if the user speed up, the user have only to jump higher obliquely forward and upward, the user can do well. As the result, it is easy to become an exercise of only terminal parts like calves and so on of the user.

Moreover, although the treadmill is an exercise assisting device which was made in order to be able to do indoor exercises substituting walking or running in outdoor, it is a big problem to be different from a real walking motion or a real running motion.

On the other hand, an exercise trajectory of the user's foot region in a real motion, which the user uses the axle moving type bicycle ergometer disclosed in Japanese Patent Application Laid Open No. 2002-78817, is something that a pedal arm rotational axis traces a rotational circumference of a circular movement (axle movement type pedaling) moving horizontally forward and backward, apparently, the exercise trajectory is different from a trajectory of a real run action (refer to FIGS. 5, 6 and Paragraph 0036 of Japanese Patent Application Laid Open No. 2002-78817).

Moreover, the ergometer of Japanese Patent Application Laid Open No. 2002-78817 focus on only an action of the foot of the user, because the user just sits the tables and rows the pedals.

The ergometer can't make the user do a linked action of the trunk and the legs (upper body and lower body), obviously, the seated user can't do the forward movement of the center of gravity, that is, "a center of gravity movement while sending a pelvis forward".

As common problems of these conventional exercise assisting devices, we can point out a thing being different from the real motion (stepping on) of the above-mentioned running, walking et cetera, a thing that effects of the aerobic exercise are low because the user's action of the trunk region (the big muscle group) becomes small by moving the terminal parts largely and so on.

SUMMARY OF THE INVENTION

The present invention, in view of the problems like these, aims to provide an exercise assisting device which becomes possible to make the user do an extremely close motion to the real motion of running, walking and so on, and which make the user do a trunk (the big muscle group)—centered action with the center of gravity movement, and which can enhance the training effect of the aerobic exercises regardless of the user, according to moving a table shape body and/or a hold body relative to a main body when the user whose the trunk is held moves the center of gravity forward, and regulating a forward inclination of the user.

Solution

The exercise assisting device of the present invention is the 1st characterized by the following; the exercise assisting device comprises a table shape body 2 which a user S steps on, a main body 3 which supports the table shape body 2 from below and a hold body 4 which is arranged on the main body 3; and the hold body 4 holds a trunk T of the user S who steps on the table shape body 2 and whose the center of gravity G is positioned forward than a step position F of the user S; when the user S whose the trunk T is held moves the center of gravity G forward while stepping on the step position F of the table shape body 2, the exercise assisting device moves the table shape body 2 upward and downward relative to the main body 3 and moves the hold body 4 forward and backward relative to the main body 3, and regulates a forward inclination of the user S.

The 2nd characteristic of the exercise assisting device of the present invention is, in addition to the above 1st characteristic, the table shape body 2 is pivotally supported to swing freely upward and downward relative to the main body 3; the hold body 4 is pivotally supported to swing freely forward and backward relative to the main body 3, and the hold body 4 abuts from the front and holds the trunk T of the user S; the exercise assisting device converts the upward and downward swinging of the table shape body 2 into the forward and backward swinging of the hold body 4 and regulates the forward inclination of the user S by a link body 5 which pivotally connects the table shape body 2 and the hold body 4, and which is pivotally supported to swing freely relative to the main body 3.

The 3rd characteristic of the exercise assisting device of the present invention is, in addition to the above 1st characteristic, the table shape body 2 is connected to move freely upward and downward through a support link 6 relative to the main body 3; the hold body 4 is supported to move straight freely forward and backward relative to the main body 3, and the hold body 4 abuts from the front and holds the trunk T of the user S; the exercise assisting device converts the upward and downward movement of the table shape body 2 into the forward and backward straight movement of the hold body 4 and regulates the forward inclination of the user S by a link body 5 which pivotally connects the table shape body 2 and the hold body 4.

The 4th characteristic of the exercise assisting device of the present invention is, in addition to the above 1st characteristic, the table shape body 2 is supported to move straight freely upward and downward relative to the main body 3; the hold body 4 is supported to move straight freely forward and backward relative to the main body 3, and the hold body 4 abuts from the front and holds the trunk T of the user S; the exercise assisting device converts the upward and downward straight movement of the table shape body 2 into the forward and backward straight movement of the hold body 4 and regulates the forward inclination of the user S by a link body 5 which pivotally connects the table shape body 2 and the hold body 4.

The 5th characteristic of the exercise assisting device of the present invention is, in addition to the above 2nd to 4th characteristics, at the time of the forward movement of the center of gravity G of the user S, the link body 5 converts the downward movement of the table shape body 2 into the forward movement of the hold body 4 and regulates the forward inclination of the user S; the exercise assisting device comprises an upward urging instrument 7 which urges the table shape body 2 upward and/or a backward urging instrument 8 which urges the hold body 4 backward.

Furthermore, in the prevent invention, "and/or" means "at least one of", for example, "an upward urging instrument 7 and/or a backward urging instrument 8" means "at least one of an upward urging instrument 7 and a backward urging instrument 8".

The 6th characteristic of the exercise assisting device of the present invention is the exercise assisting device comprises a table shape body 2 which a user S steps on, a main body 3 which supports the table shape body 2 from below and a hold body 4 which is arranged on the main body 3; and the hold body 4 holds a trunk T of the user S who steps on the table shape body 2 and whose the center of gravity G is positioned forward than a step position F of the user S; the exercise assisting device regulates a forward inclination of the user S whose the trunk T is held while moving relatively the table shape body 2 and/or the hold body 4 relative to the main body 3.

Owing to these characteristics, in the exercise assisting device of the present invention, the user S becomes possible to keep the forward inclination posture Z to topple in principle, without griping with both hands of the user S (that is, a muscles of a periphery of a scapula don't contract excessively, the muscles are in a relaxation state), and a load which is applied into the legs of user S decreases only a portion of applying the body weight forward, and also it becomes easy to obtain a feeling which the pelvis of the user S gets on knees when the user S steps on by the feet, according to comprising the table shape body 2 which the user S steps on, the main body 3 which supports the table shape body 2 from below and the hold body 4 which is arranged on the main body 3, and the hold body 4 of holding the trunk T of the user S who steps on the table shape body 2 and whose the center of gravity G is positioned forward than a step position F of the user S.

In addition to this, it becomes possible to obtain a touch which the user S goes forward while receiving a counterforce from the table shape body 2 by stepping on the table shape body 2, at the same time, the user S (the trunk T) inclines forward and moves the center of gravity G forward while the user S steps on the step position F which is same as the beginning in the table shape body 2, because the forward movement of the center of gravity G of the user S is mainly done by the extension of a hip joint (that is, the movement of the center of gravity G by the extension of the hip joint becomes more than the forward movement of the center of gravity G by the forward inclination of the trunk T), it becomes possible to make any user S do an extremely close motion to the real motion of running, walking and so on, as the user S extends steadily the hip joint while obtaining the feeling which the pelvis gets on the knees, and the user S can actualize enhancement of "the center of gravity movement while sending a pelvis forward" and enhancement of the training effect of the aerobic exercise by the muscle contractions of the big muscle group, in a case of moving the table shape body 2 upward and downward relative to the main body 3 and moving the hold body 4 forward and backward relative to the main body 3 when the user S whose the trunk T is held moves the center of gravity G forward while stepping on the step position F of the table shape body 2, and regulating a forward inclination of the user S.

Furthermore, even if the step position F of the table shape body 2 moves forward and backward, and even if movable ranges of the hip joints are different from each user S, the movement and the difference are permitted by a portion of the upward and downward movement of the table shape body 2 and the forward and backward movement of the hold body 4.

At this point, the upward and downward movement of the present invention means first the upward and downward straight movement which has only a portion of the movement along an upward and downward direction. Besides, if a portion of the movement along a forward and backward direction is smaller than the portion of the movement along the upward and downward direction, the upward and downward movement of the present invention means the upward and downward movement which has the portion of the movement along the forward and backward direction too in addition to the portion of the movement along the upward and downward direction. The upward and downward movement of the present invention includes, as mentioned below, the upward and downward swinging, the upward and downward movement through a link, the straight movement along an oblique direction (the downward and backward movement, or the upward and forward movement) and the movement along curved roller guide and rail and so on.

And, the forward and backward movement of the present invention, in the same way, means first the forward and backward straight movement which has only the portion of the movement along the forward and backward direction. Besides, if the portion of the movement along the upward and downward direction is smaller than the portion of the movement along the forward and backward direction, the forward and backward movement of the present invention means the forward and backward movement which has the portion of the movement along the upward and downward direction too in addition to the portion of the movement along the forward and backward direction. The forward and backward movement of the present invention includes, as mentioned below, the forward and backward swinging, the forward and backward movement through a link, the straight movement along an oblique direction (the backward and downward movement, or the forward and upward movement) and the movement along curved roller guide and rail and so on.

As shown in FIG. 1, the user S can do "the center of gravity movement while sending a pelvis forward", and also the user S becomes possible to do a free action owing to a body build, a muscle strength and the movable range of the joint of each user S, without an exercise trajectory of the foot of the user S himself or herself of being restrained by pedals et cetera, according to pivotally supporting the table shape body 2 to swing freely upward and downward relative to the main body 3, and pivotally supporting the hold body 4 to swing freely forward and backward relative to the main body 3 and abutting from the front and holding the user S, and converting the upward and downward swinging of the table shape body 2 into the forward and backward swinging of the hold body 4 and regulating the forward inclination of the user S by a link body 5 which pivotally connects the table shape body 2 and the hold body 4, and which is pivotally supported to swing freely relative to the main body 3.

Furthermore, precisely because the action of the foot is free, each user S understands the form at the time of running actually, that is, the real motion (Real Run (registered trademark)). At the same time, it becomes a clue that the user S masters better form (Master Run (registered trademark)).

That is the user S becomes possible to reverse the right and left feet quickly with good balance in the air, and the user S becomes easy to master a line of the trunk T and the angle of a hip joint K, knee joints H and ankles, which are suitable for transmitting a force to a stepping surface 2*a* (ground).

And, the table shape body 2 and the hold body 4 contact with only each pivotal axis of the main body 3, and a contact range of the table shape body 2 and the main body 3, and a contact range of the hold body 4 and the main body 3 become narrow, it can make a loss and sound by friction be small, according to pivotally supporting the table shape body 2 and the hold body 4.

Moreover, if we focus on swinging of the hold body 4, a reaction at the time that the whole hold body 4 moves forward is released in the upward and downward direction too and is restrained by a circular movement around pivotal axis, it becomes possible of making the whole exercise assisting device 1 hard to slip off forward.

As shown in FIG. 4, the user S can do "the center of gravity movement while sending a pelvis forward" and the free action owing to the user S at the same time, in a case of connecting the table shape body 2 to move freely upward and downward through a support link 6 relative to the main body 3, and supporting the hold body 4 to move straight freely forward and backward relative to the main body 3 and the hold body 4 of abutting from the front and holding the trunk T of the user S, and converting the upward and downward movement of the table shape body 2 into the forward and backward straight movement of the hold body 4 and regulating the forward inclination of the user S by a link body 5 which pivotally connects the table shape body 2 and the hold body 4, in the same way.

In addition to this, the table shape body 2 becomes possible not only to be along the upward and downward direction, but also to do the movement including the upward and downward direction and also the forward and backward direction (oblique movement), and if the stepping direction of the user S in the forward inclination posture Z becomes oblique, the user S becomes easy to obtain the feeling of stepping on, according to the table shape body 2 of connecting the main body 3 through the support link 6.

As the FIG. 6, the user S can do "the center of gravity movement while sending a pelvis forward" and the free action owing to the user S at the same time, in a case of supporting the table shape body 2 to move straight freely upward and downward relative to the main body 3, and supporting the hold body 4 to move straight freely forward and backward relative to the main body 3, and the hold body 4 of abutting from the front and holding the trunk T of the user S, and converting the upward and downward straight movement of the table shape body 2 into the forward and backward straight movement of the hold body 4 and regulating the forward inclination of the user S by a link body 5 which pivotally connects the table shape body 2 and the hold body 4.

And, the main body can support the table shape body 2 and the hold body 4 in a wider range stably, because of supporting both the table shape body 2 and the hold body 4 to move straight freely relative to the main body 3 (for example, according to being along linear roller guide and linear rail et cetera).

Further and additionally, it is easy to elongate a distance between the table shape body 2 and the hold body 4, because the moving direction of the table shape body 2 is a same direction as the acting direction of gravity, at the same time, the moving direction of the hold body 4 is a same direction as the moving direction of the center of gravity G of the user S, because the elongation of the distance is mainly compensated by the extension of the hip joint, it becomes possible to make the user S do a running real motion while obtaining the feeling which the pelvis of the user S gets on the knees, according to the link body 5 of converting the downward movement of the table shape body 2 into the forward movement of the hold body 4 at the time of the forward movement of the center of gravity G of the user 5, and regulates the forward inclination of the user S.

At the same time, it becomes possible to increase moreover training load because the user S steps on the table shape body 2 by stronger force while resisting a urging force of the urging instrument 7, 8, according to comprising an upward urging instrument 7 which urges the table shape body 2 upward and/or a backward urging instrument 8 which urges the hold body 4 backward.

Furthermore, the user S obtains the counterforce from the stepping surface 2*a* conversely, naturally the feet of the user S rise forward and high (not the user S raises the feet, but the feet rise), it is easy for the user S to master an ideal form (the run motion, the walk motion) in the relaxation state.

And then, it can actualize the obtainment of the feeling which the pelvis of the user S gets on the knees, and a permission of a difference of the step position F and the movable range of the user S while regulating a forward inclination of the user S when the trunk T is held, according to the hold body 4 of holding a trunk T of the user S who steps on the table shape body 2 and whose the center of gravity G is positioned forward than a step position F of the user S, and regulating the forward inclination of the user S while moving relatively the table shape body 2 and/or the hold body 4 relative to the main body 3.

Furthermore, the relative movement of the table shape body 2 and/or the hold body 4 relative to the main body 3 of the present invention means first the straight movement which has only a portion of movement relative to main body 3 along the upward and downward direction, the forward and backward direction or the oblique direction. Besides, if it is changed that a positional relation of the table shape body 2 and/or the hold body 4 relative to the main body 3, and if it is changed that a distance from the main body 3 to the table shape body 2 and/or the hold body 4, regardless of a direction to move, and linear or curved, the relative movement of the table shape body 2 and/or the hold body 4 relative to the main body 3 of the present invention means swinging, the movement through a link, the movement along curved roller guide and rail and so on.

There is nothing but user 5, who keep the forward inclination posture Z to topple in principle (the center of gravity G is positioned forward than the step position F of the user S) without griping with both hands of the user S in the relaxation state, mainly compensates the change of the positional relation of the table shape body 2 and/or the hold body 4 relative to the main body 3 and the change of the distance by the hold body 4 of the trunk T, it becomes possible to make the user S do the running real motion while obtaining the feeling which the pelvis of the user S gets on the knees.

Furthermore, the exercise assisting device of the present invention, besides the above-mentioned characteristics, may comprise a movement ratio varying instrument which changes the pivotal position of the link body 5 and the table shape body 2 and/or the hold body 4 and which varies a ratio of a distance of a forward and backward movement of the hold body 4 relative to a upward and downward movement of the table shape body 2.

As other characteristic, the exercise assisting device of the present invention may comprises a table shape body 2 which a user S steps on, a main body 3 which supports the table shape body 2 from below and a hold body 4 which is arranged on the main body 3; and the hold body 4 may hold a trunk T of the user S who steps on the table shape body 2 and whose the center of gravity G is positioned forward than a step position F of the user S; when the user S whose the trunk T is held moves the center of gravity G forward while stepping on the step position F of the table shape body 2, the exercise assisting device may move the table shape body 2 upward and downward relative to the main body 3, and may regulate a forward inclination of the user S.

The exercise assisting device of the present invention may comprises a table shape body 2 which a user S steps on, a main body 3 which supports the table shape body 2 from below and a hold body 4 which is arranged on the main body 3; and the hold body 4 may hold a trunk T of the user S who steps on the table shape body 2 and whose the center of gravity G is positioned forward than a step position F of the user S; when the user S whose the trunk T is held moves the center of gravity G forward while stepping on the step position F of the table shape body 2, the exercise assisting device may move the hold body 4 forward and backward relative to the main body 3, and may regulate a forward inclination of the user S.

The exercise assisting device of the present invention may move the table shape body 2 downward at the time of the forward movement of the center of gravity G of the user S, and may regulate the forward inclination of the user S.

The exercise assisting device of the present invention may move the hold body 4 forward at the time of the forward movement of the center of gravity G of the user S or backward at the time of the forward movement of the center of gravity G of the user 5, and may regulate the forward inclination of the user S.

The exercise assisting device of the present invention may comprise pedals 71 through which the user S steps on the table shape body 2, and the pedals 71 are mounted to move freely along a rail 72 which is elongated forward and upward from the main body 3.

For these reasons, the user S can adapt not only the body build of the user S but the degree of inclining the trunk T forward supported by the hold body 4, and can change the training load owing to the request of the user S which is from an athlete to aim the enhancement of the athletic abilities to the elderly person to do health promotion, in a case of comprising a movement ratio varying instrument which changes the pivotal position of the link body 5 and the table shape body 2 and/or the hold body 4 and which vary a ratio of the distance of the forward and backward movement of the hold body 4 relative to the upward and downward movement of the table shape body 2.

And, in the same way as the above, the differences of the step position F and the movable range of the user S are permitted by a portion of the movement of the hold body 4, it becomes possible to extend steadily the hip joint of the user S, in a case of comprising the table shape body 2, the main body 3 and the hold body 4 when the user S who is held by the hold body 4 in the forward inclination posture Z moves the center of gravity G forward, and regulating the forward inclination of the user S, at the same time, and the regulation of the forward inclination of the user S of doing while moving the hold body 4 forward and backward.

For the same reason, the differences of the step position F and the movable range of the user S can be permitted, the user S can obtain the feeling which the pelvis of the user S gets on the knees, in a case of moving the table shape body 2 upward and downward, and regulating the forward inclination of the user S.

That is, if it makes the table shape body 2 and/or the hold body 4 move relative to the main body 3, the exercise assisting device regulates the forward inclination of the user S when the trunk T is held, it can actualize the obtainment of the feeling which the pelvis of the user S gets on the knees, and a permission of a difference of the step position F and the movable range of the user S.

Moreover, the table shape body 2 separates from the hold body 4 which doesn't change a height position of the hold body 4, the distance between the hold body 4 and the table shape body 2 elongates, in a case of moving the table shape body 2 downward at the time of the forward movement of the center of gravity G of the user S, and regulating the forward inclination of the user S. The hip joint is extended and mainly compensates a portion of the elongation of the distance, it can make the user S do a closer motion to the running real motion.

And, owing to the degree that the table shape body 2 moves downward, the exercise assisting device gives the user S a feeling of kicking a hard floor surface and a feeling like running on sandy place and so on, it becomes possible to increase or decrease the load to the user S.

In the same way, the hold body 4 separates from the table shape body 2 which doesn't change a forward and backward position of the table shape body 2, the distance between the hold body 4 and the table shape body 2 elongates, in a case of regulating the forward inclination of the user S while the hold body 4 of moving forward at the time of the forward movement of the center of gravity G of the user S. The extension of the hip joint mainly compensates the elongation of the distance, it can make the user S do the running real motion while obtaining the feeling which the pelvis of the user S gets on the knees.

And, the regulation of the forward inclination of the user S in this case means that the degree of inclining forward is fixed (limited) owing to the degree of moving the hold body 4 forward.

Conversely, even if the center of gravity G of the user S moves forward, the extension of the hip joint is promoted stronger because the trunk T, inversely, is moved by the hold body 4, in a case of regulating the forward inclination of the user S while the hold body 4 of moving backward at the time of the forward movement of the center of gravity G of the user S. Furthermore, the backward movement of the hold body 4 includes moving backward and upward.

Though the pedals 71 and the rail 72 guide and support the feet of the user S, the user S can tread on the table shape body 2, the user S can obtain a feeling of treading on and a counterforce from the table shape body 2 owing to a generation and a purpose, in a case of comprising pedals 71 through which the user S steps on the table shape body 2, and of the pedals 71 of being mounted to move freely along a rail 72 which is elongated forward and upward from the main body 3.

Effect of the Invention

The exercise assisting device of the present invention becomes possible to make the user do the trunk-centered action with the center of gravity movement, the exercise assisting device makes the user do an extremely close motion to the real motion of running, walking and so on, we can enhance the training effect of the aerobic exercises regardless of the user, according to moving a table shape body and/or a hold body relative to a main body when the user whose the trunk is held moves the center of gravity forward, and regulating a forward inclination of the user.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Modes for Carrying Out the Invention

The embodiments of the present invention are explained to refer to the figures below.

The 1st Embodiment

Figure 1:
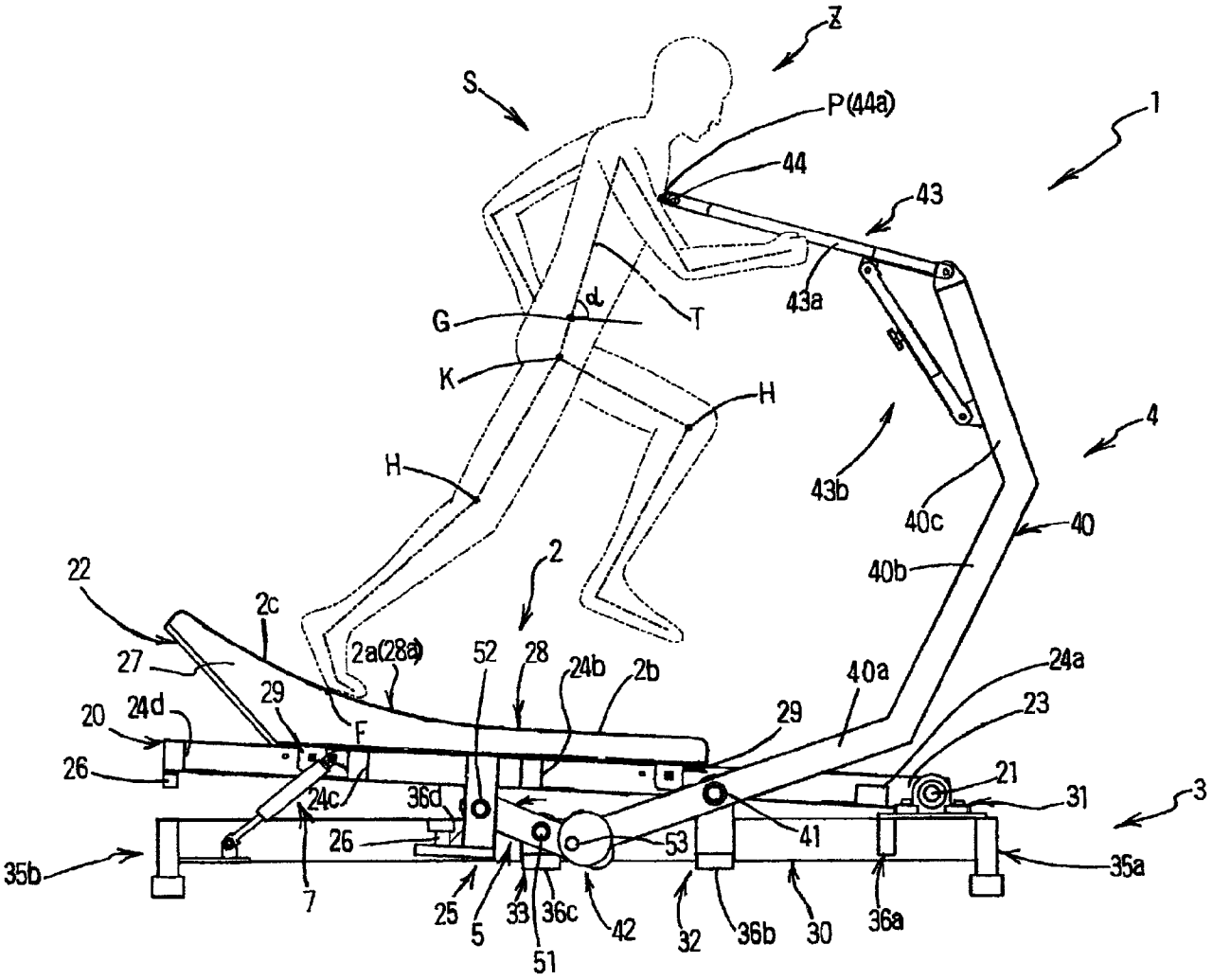
FIG. 1 shows a sectional side view of the exercise assisting device of the 1st embodiment of the present invention.
Figure 2:
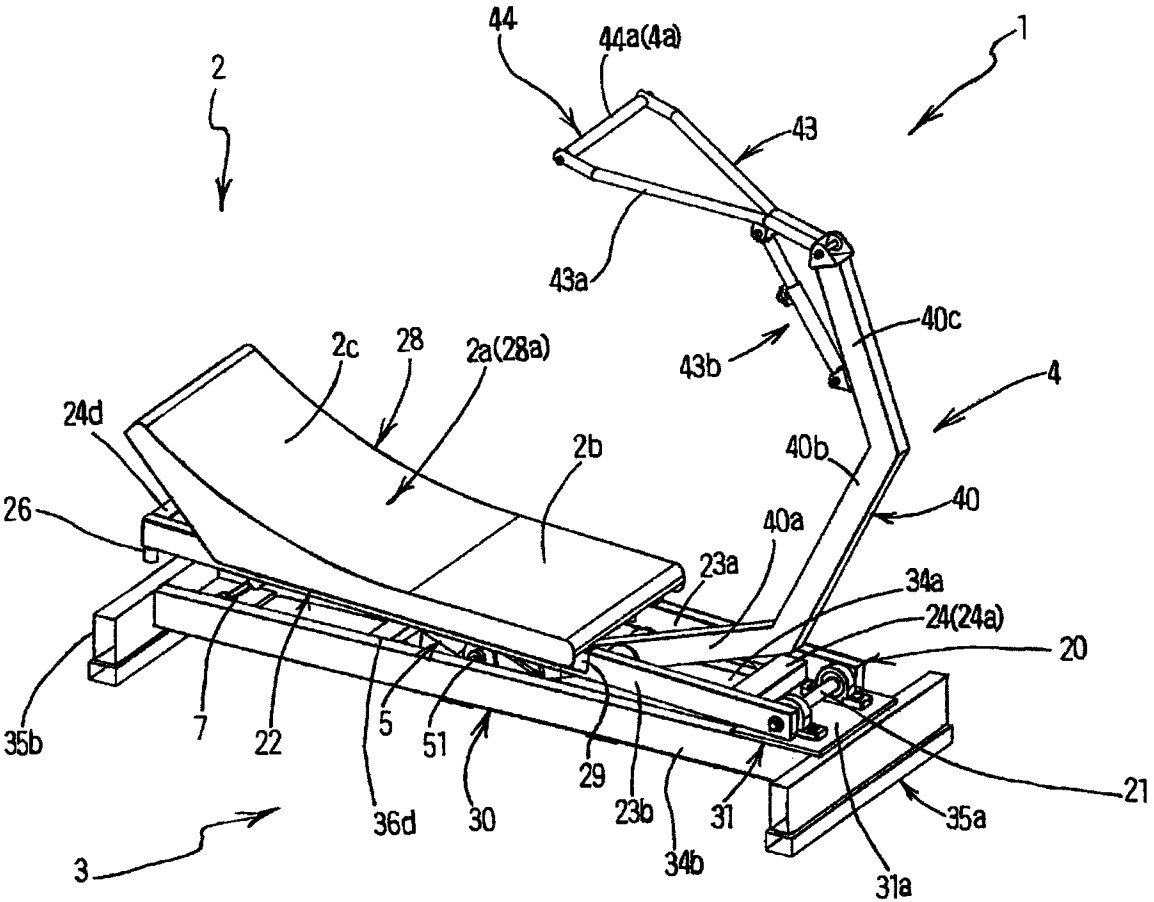
FIG. 2 shows a perspective view of the exercise assisting device of the 1st embodiment.
Figure 3:
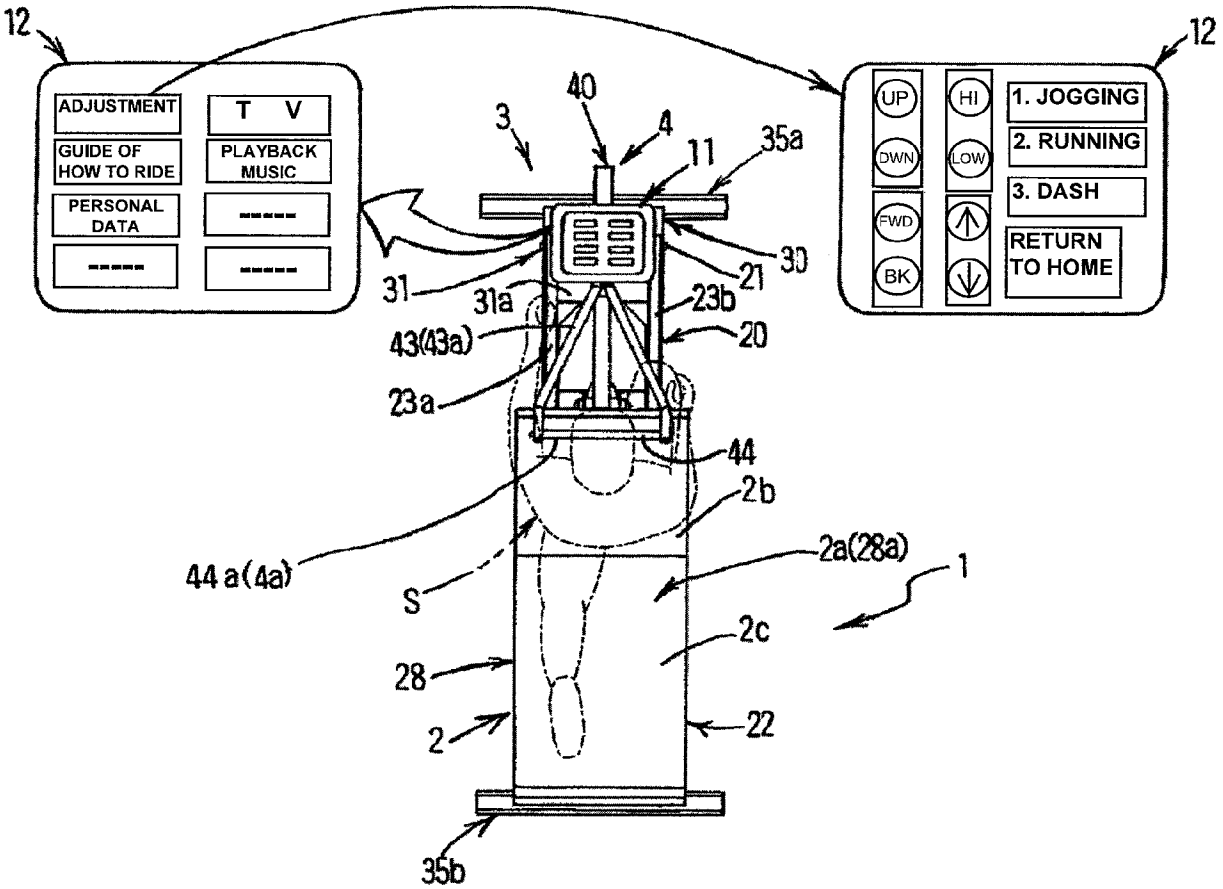
FIG. 3 shows a schematic view of the exercise assisting device and a display part of the 1st embodiment.

In FIGS. 1 to 3, the exercise assisting device 1 of the 1st embodiment of the present invention is shown.

The exercise assisting device 1 comprises a table shape body 2 which a user S steps on, a main body 3 which a forward and backward length is longer than other length and supports the table shape body 2 from below, a hold body 4 which are arranged on the main body 3, a link body 5 which converts the upward and downward movement of the table shape body 2 into the upward and downward movement of the hold body 4 and an upward urging instrument 7 which urges the table shape body 2 upward.

"The Table Shape Body 2"

As shown in FIGS. 1, 2, the table shape body 2 of the 1st embodiment comprises a table frame structure 20 which the forward and backward length is longer than other length, a table pivotal axis 21 which pivotally supports a front end part of the table frame structure 20 to swing freely relative to the main body 3 and a stepping surface structure 22 which is provided on the table frame structure 20 and has a stepping surface 2*a*.

The table frame structure 20 comprises right and left table frames 23*a*, 23*b* which a upward and downward length is longer than other length, four connecting members 24*a*, 24*b*, 24*c*, 24*d* which connect between the right and left table frames 23*a*, 23*b*, a table connecting part 25 which connect the table frame structure 20 with the link body 5.

The right and left table frames 23*a*, 23*b* are hollow prisms, and have a slightly shorter forward and backward length than the forward and backward length of the main body 3. A section of each table frame 23*a*, 23*b* is formed in a rectangular shape which the upward and downward length is longer than other length.

The four connecting members 24*a* to 24*d* of the table shape body 2 are, in order from the front, a front connecting member 24*a* which connects the right and left table frames 23*a*, 23*b* just behind a position of the table pivotal axis 21, front and rear two support connecting members 24*b*, 24*c* which connect the right and left table frame 23*a*, 23*b* at a back position than an intermediate position in the forward and backward direction and a rear connecting member 24*d* which connects a rear end part of the right and left table frames 23*a*, 23*b*.

And, four connecting members 24*a* to 24*d* are also hollow prisms. A length of each connecting members 24*a* to 24*d*, that is, a distance between the right and left table frames 23*a*, 23*b* is same as a shoulder width of the user S or a slightly wider than the shoulder width of the user S.

Furthermore, plural receiving holes in order to mount a mounting parts 29 described later of the stepping surface structure 22 are provided along a longer direction of the table frames 23*a*, 23*b*, in a central part in the forward and backward direction, and a rear part of each table frame 23*a*, 23*b*.

A section of the front connecting member 24*a* is also formed in the rectangular shape, and the front connecting member 24*a* is arranged in a direction which the forward and backward direction becomes longer than other direction. A lower face of the front connecting member 24*a* is provided at a same height position as lower faces of the right and left table frames 23*a*, 23*b* (in flushness). Furthermore, at this time, approximately triangle reinforcing boards in a plan view may be mounted across a rear face of the front connecting member 24*a* and a right or left inner face of each table frame 23*a*, 23*b*.

The front and rear two support connecting members 24*b*, 24*c* connect the right and left table frames 23*a*, 23*b*, and also are supporting the above table connecting part 25 and an upper end of the upward urging instrument 7.

The two support connecting members 24*b*, 24*c* are a front support connecting member 24*b* which is provided just behind an intermediate position in the forward and backward direction of the right and left table frames 23*a*, 23*b* (the intermediate position in the forward and backward direction between the front connecting member 24*a* and the rear connecting member 24*d*) and a rear support connecting member 24*c* which is provided at a position separated by only a predetermined distance backward from the front support connecting member (the intermediate position in the forward and backward direction between the front support connecting member 24*b* and the rear connecting member 24*d*).

Though sections of the front and rear support connecting members 24*b*, 24*c* are also formed in the rectangular shape, the front and rear support connecting members 24*b*, 24*c* are different from the front connecting member 24*a*, the front and rear support connecting members 24*b*, 24*c* are arranged in a direction which the upward and downward direction becomes longer than other direction.

Lower faces of the front and rear support connecting members 24*b*, 24*c* are provided at a same height position as the lower faces of the right and left table frames 23*a*, 23*b*. Furthermore, at this time, approximately triangle reinforcing boards in the plan view may be mounted across a front face side of the front support connecting member 24*b* and the right or left inner face of each table frame 23*a*, 23*b*, and approximately triangle reinforcing boards in the plan view may be mounted across a rear face side of the rear support connecting member 24*c* and the right or left inner face of each table frame 23*a*, 23*b*.

Though the above-mentioned table connecting part 25 is provided between the front support connecting member 24*b* and the rear support connecting member 24*c* of the table shape body 2, the table connecting part 25 comprises right and left two table support members which are elongated in the forward and backward direction, an axis support member which is clamped by the table support members and an upper swing stopper member which is elongated backward from the axis support member.

The right and left table support members are hollow prisms, and are arranged across a rear face of the front support connecting member 24*b* and a front face of the rear support connecting member 24*c*, are arranged at a right and left symmetrical position.

A section of each table support member is formed in the rectangular shape which the upward and downward length is longer than other length.

The axis support member is also a hollow prism, and a section of the axis support member is formed in the rectangular shape which the forward and backward length is longer than other length, the axis support member is elongated in the upward and downward direction (the direction orthogonal to the right and left table frames 23*a*, 23*b*).

An upper face of the axis support member is provided at a same height position as an upper face of each table frame 23*a*, 23*b*, an upper face of each support connecting member 24*b*, 24*c* and an upper face of each table support member, a lower end part of the axis support member is provided in such a way as to protrude downward from the table frame structure 20.

A pipe body for inserting a table link connecting axis 52 is provided and directed the longer direction rightward and leftward at a middle part in the protrusion direction of the axis support member.

The upper swing stopper part is a hollow prism, a section of the upper swing stopper part is formed in an approximately square shape.

A buffer material 26 which is an approximately circular truncated cone shape is provided in an upward protruding shape at a middle part in the forward and backward direction of an upper face of the upper swing stopper part, an upper face of the buffer material 26 abuts on a lower face of a swing stopper connecting member 36*d* described later of the main body 3 at the time that the table shape body 2 swings upward by only a predetermined angle.

The buffer material 26 may be made from an elastic material like gum et cetera, besides raw material like a spring and so on for absorbing impact.

An axis member is elongated downward from a lower face of the buffer material 26, the axis member penetrates the upper swing stopper part upward and downward to the lower face of the upper swing stopper part. A lower end part of the axis member protrudes downward from the lower face of the upper swing stopper part, the buffer material 26 is fixed on the upper swing stopper part, according to mounting on the protruding portion by a fixing tool like a nut et cetera.

A plate-shaped protruding part which protrudes downward from a rear end of the upper swing stopper part is provided at the rear end of the upper swing stopper part.

A protruding distance of the protruding part is longer than an upward and downward height of the above-mentioned fixing tool like a nut et cetera, and if the table shape body 2 swings upward and the upper swing stopper part is about to contact a setting surface of the exercise assisting device 1, the protruding part first hit the setting surface, and the protruding part protects the fixing tool of the buffer material 26.

Furthermore, at this time, an approximately triangle reinforcing board in the plan view may be mounted across the upper face of the upper swing stopper part and a rear face of the axis support member.

And, each of the right and left buffer materials 26 which are the approximately circular truncated cone shape is provided in a downward protruding shape at the rear end part of the right and left table frames 23*a*, 23*b* too, the lower faces of the buffer materials 26 abut on an upper face of a main body frame structure 30 of the main body 3 at the time that the table shape body 2 swings downward by only a predetermined angle.

The above-mentioned table pivotal axis 21 of the table shape body 2 is mounted penetratingly on a front end part of the right and left table frames 23*a*, 23*b*, and the table pivotal axis 21 is pivoted by, a table bearing part 31 which is provided at an upper face of the main body 3's front part.

Consequently, the table shape body 2 does a circular movement around the table pivotal axis 21. Furthermore, the circular movement of the table shape body 2 can be approximated as a linear movement along the upward and downward direction, because a swinging angle of the table shape body 2 is strictly limited, at the same time, the forward and backward length of the table frame structure 20 is set as long as possible like being close to the forward and backward length of the main body 3 and so on.

The above-mentioned stepping surface structure 22 of the table shape body 2 comprises right and left surface frames 27, 27 which are elongated in the forward and backward direction, five connecting members which connect between the right and left surface frames 27, 27, a stepping surface member 28 which covers the surface frame 27 and the connecting member from above, a mounting part 29 which mounts the stepping surface structure 22 on the table frame structure 20.

Each of the right and left surface frames 27 of the stepping surface structure 22 is formed each of same-shaped two board materials to protrude upward side by side from right and left edges of a board material which has an approximately same width as widths of the above-mentioned table frames 23*a*, 23*b*, and the forward and backward length is longer than other length.

An upper end edge of each surface frame 27 is, in a side view, formed in a rear rising shape which the more backward it goes, the higher it becomes gradually, after it goes straight backward by a predetermined distance from a front end of each surface frame 27.

Furthermore, a rear end edge of each surface frame 27 is formed straight backward and upward from the surface frame's rear part.

A distance between the right and left surface frames 27, 27 is approximately same as the distance between the above table frames 23*a*, 23*b*, and is same as the shoulder width of the user S or a slightly wider than the shoulder width of the user S.

And, a length of each surface frame 27 is a sufficiently larger length than a stride at the time that the user S runs, and the length of each surface frame 27 is the forward and backward length of an upper face part 28*a* (the stepping surface 2*a*) of the above stepping surface member 28.

The five connecting members of the stepping surface structure 22 are, in order from the front, provided with approximately equal intervals along an upper end shape of the right and left surface frames 27, 27.

The five connecting members are also hollow prisms, and sections of the five connecting members are formed in the rectangular shape which the forward and backward length is longer than other length.

A length of each connecting member is longer than the distance between the right and left table frames 23*a*, 23*b*, and is a sufficiently wider length than the shoulder width of the user S or a distance between the right foot and the left foot of the user S.

Furthermore, the length of the connecting member is a rightward and leftward width of the upper face part 28*a* (the stepping surface 2*a*) of the stepping surface member 28.

The stepping surface member 28 of the stepping surface structure 22 puts on and covers the right and left surface frames 27, 27 and the five connecting members from above.

The stepping surface member 28 comprises an upper face part 28*a*, a front face part, right and left side face parts and a rear face part.

The upper face part 28*a* (that is, the stepping surface 2*a*) of the stepping surface member 28 comprises a flat portion 2*b* which are elongated backward by only a predetermined distance from the upper face part 28*a*'s front end and a rear rising portion 2*c* which becomes high gradually from a rear end of the flat portion, because the upper face part 28*a* puts on the table frames 23*a*, 23*b* along an upper end of the table frames 23*a*, 23*b* which is the rear rising shape. Furthermore, the user S is easy to obtain a rebound from the table shape body 2 (the stepping surface 2*a*), because of stepping on (landing) a turning point from the flat portion 2*b* to the rear rising portion 2*c*.

The front face part of the stepping surface member 28 covers front ends of the right and left surface frames 27, 27 from the front, and we don't see each surface frame 27 from the front by the front face part, because an upward and downward height of the front face part is approximately same as an upward and downward height of each surface frame 27.

Furthermore, non-slip like covering a surface by rubber and so on is applied on the stepping surface 2*a*, the stepping surface 2*a* has a sufficiently area for the user S of stepping on by the feet.

In the same way, the right and left side face parts cover the right and left surface frames 27, 27 from the right and left outsides, and each surface frame 27 and we don't see each connecting member from the right and left outsides by the side face parts, because a shape of the side face parts are approximately same in the side view as a shape of each surface frame 27 or are a slightly backward longer than the shape of each surface frame 27.

Furthermore, though we don't see a rear and upper end face of each surface frame 27, because a rear face part of the stepping surface member 28 covers only the rear and upper end face of the right and left surface frames 27 from the rear and upper, the stepping surface structure 22 is formed in a backward opening shape, because the rear face part of the stepping surface member 28 covers ranges except the rear and upper end face of the right and left surface frames 27.

The mounting part 29 of the stepping surface structure 22 is formed each of long and narrow two board materials to protrude downward from right and left edges of a long and narrow board material which has an approximately same width as widths of the above-mentioned table frames 23*a*, 23*b*, and the forward and backward length is longer than other length, and the mounting part 29 is formed like putting on the table frames 23*a*, 23*b* from above in a state which each of the table frames 23*a*, 23*b* fits between the two board materials.

The forward and backward length of the mounting part 29 is firmed to be slightly shorter than the forward and backward length of each surface frame 27 and the stepping surface member 28, and is firmed to be slightly shorter than a length of a lower end edge (for more information, from a slightly backward position of the front end of each surface frame 27 to a slightly forward position of the point which the surface frame 27's rear end face starts to rise the rear) of each surface frame 27 which is elongated straight forward and backward.

The mounting part 29 which the forward and backward length is longer than other length provides each mounting hole at a front end part and a rear end part of the mounting part 29 at least, and the mounting hole and any of plural receiving holes which are provided at a middle part of each table frame 23*a*, 23*b* are inserted, and the stepping surface structure 22 is fixed on the table frame structure 20 by the fixing tool like a mounting screw et cetera.

Furthermore, it is possible to change the forward and backward position of the stepping surface structure 22 relative to the table frame structure 20, owing to the body build and the purpose of the user S, according to appropriately begin selected from the plural receiving holes, at the time of inserting into the mounting hole.

"The Main Body 3"

As shown in FIGS. 1, 2, the main body 3 of the 1st embodiment comprises a main body frame structure 30 which the forward and backward length is longer than other length, a table bearing part 31 which pivotally supports to swing freely the table shape body 2 by a front end part of the main body frame structure 30, a hold bearing part 32 which pivotally supports to swing freely the hold body 4 by a middle part in the forward and backward direction of the main body frame structure 30, a link bearing part 33 which pivotally supports to swing freely the link body 5 by a central part in the forward and backward direction of the main body frame structure 30.

The main body frame structure 30 comprises right and left main body frames 34*a*, 34*b* which are elongated in the forward and backward direction, a front leg 35*a*, a rear leg 35*b* which connect each of a front end and a rear end of the right and left main body frames 34*a*, 34*b* and four connecting members 36*a*, 36*b*, 36*c*, 36*d* which connect between the right and left main body frames 34*a*, 34*b*.

The right and left main body frames 34*a*, 34*b* are also hollow prisms, and is formed longer than each table frame 23*a*, 23*b* by only a portion of the length of the table bearing part 31 et cetera. And, a section of each main body frame 34*a*, 34*b* is also formed in the rectangular shape which the upward and downward length is longer than other length, both the upward and downward length and the rightward and leftward width of the section of each main body frame 34*a*, 34*b* are formed larger than the section of each table frame 23*a*, 23*b* (that is, the main body frames 34*a*, 34 are thicker than the table frames 23*a*, 23*b*).

We describe the front and rear legs 35*a*, 35*b* of the main body 3.

The front leg 35*a* and the rear leg 35*b* may be something to support the exercise assisting device 1 and the user S which does the real motion, according to arranging and directing the hollow prisms rightward and leftward et cetera, for example, the front leg 35*a* and the rear leg 35*b* may be as follows.

In the first place, we describe the front leg 35*a*, the front leg 35*a* comprises an upper beam member which mounts across right and left front ends of the main body frames 34*a*, 34*b* and a lower beam member which mounts through plural buffer.

In this case, the upper beam member is directed a hollow prism which has approximately same thickness as each main body frame 34*a*, 34*b*, and is arranged in a direction which the upward and downward length of a rectangular section is longer than other length. A rightward and leftward length of the upper beam member is larger than a distance between right and left outside faces of the main body frames 34*a*, 34*b*, moreover, the rightward and leftward length of the upper beam member is larger than the rightward and leftward width of the stepping surface 2*a* of the above-mentioned table shape body 2.

Each of approximately column shaped buffer materials is provided at a right and left end part and a central part of the lower face of the upper beam member, the buffer materials, in the same way as the buffer materials 26 of the table shape body 2, may be also made from the elastic material like the gum et cetera, besides the raw material like a spring and so on for absorbing impact.

Axis members are elongated from each of upper and lower faces of the buffer materials, and the axis member enters by only a portion of a predetermined length through an insertion hole into the upper and lower beam members.

A face direction of the upper beam member relative to the lower beam member is positioned by the entry of the axis member.

And, if vibration is transmitted from the table shape body 2 and the hold body 4 to the main body 3, it permits the slippage of the position of the face direction of the upper beam member relative to the lower beam member, it is possible to release the vibration, because of only entering the axis member into the upper and lower beam member.

Furthermore, the axis member may be fixed on the upper and lower beam members by a screw et cetera, in the case, the vibration is alleviated by the buffer materials which are formed from the raw material for absorbing impact.

The lower beam member under the buffer materials is also a hollow prism, and a section of the lower beam member is formed in the rectangular shape which the forward and backward length is longer than other length. A forward and backward width of the lower beam member is formed wider than the forward and backward width of the upper beam member, and a contact area with the setting surface and the lower beam member is larger.

Moreover, the rightward and leftward lengths of the upper and lower beam members of the front leg 35*a* are larger than the distance between the right and left outside faces of the main body frames 34*a*, 34*b*, moreover, the rightward and leftward lengths of the upper and lower beam members are larger than the rightward and leftward lengths of the stepping surface 2*a* of the above-mentioned table shape body 2.

Thus, the exercise assisting device 1 is more stabilized, the table shape body 2 and the hold body 4 are supported steadily, and it is possible for the user S to do the real motion of walking, running et cetera stably on the table shape body 2, according to making the forward and backward width and the rightward and leftward width of the front leg 35*a* large.

Furthermore, the rear leg 35*b* comprises a same constitution as the upper beam member, the plural buffer materials and the lower beam member of the front leg 35*a* except the point of mounting the rear leg 35*b* across the right and left rear ends of the main body frames 34*a*, 34*b*.

Four connecting members 36*a* to 36*d* of the main body 3 are, in order from the front, a front connecting member 36*a* which is provided just behind a position of the table bearing part 31, a hold connecting member 36*b* which is provided at an approximately one-third position from the front end of the right and left table frames 23*a*, 23*b* and at a lower of the hold bearing part 32, a link connecting member 36*c* which is provided at an approximately forward and backward position and at a lower of the link bearing part 33 and a swing stopper connecting member 36*d* which is provided at an approximately two-third position from the front end of the right and left table frames 23*a*, 23*b* and at a upper of the upper swing stopper part of the table shape body 2.

And, the four connecting members 36*a* to 36*d* are also approximately hollow prisms, and a length of each connecting member 36*a* to 36*d*, that is, a distance between the right and left main body frames 34*a*, 34*b* is approximately same as the distance between the right and left table frames 23*a*, 23*b*, and the distance between the right and left main body frames 34*a*, 34*b* is same as the shoulder width of the user S or slightly wider than the shoulder width of the user S.

The front connecting member 36*a* is arranged in a direction which the upward and downward length of a rectangular section is longer than other length, and an upper face of the front connecting member 36*a* is provided to abut on a lower face of the support board 31*a* which supports the table bearing part 31, and the front connecting member 36*a* supports the rear part of the support board 31*a* of the table bearing part 31.

Right and left end parts of the hold connecting member 36*b* cut off in an approximately L-shape in a front view, in order to be able to connect the hold connecting member 36*b* not only across right and left inner faces of the right and left main body frames 34*a*, 34*b*, but across from the right and left inner faces to a lower face of the right and left main body frames 34*a*, 34*b*.

Furthermore, reinforcing boards may be mounted across the hold connecting member 36*b*'s front face and the right and left inner faces of the right and left main body frames 34*a*, 34*b*, in the case, rear faces of the reinforcing boards and the hold connecting member 36*b*'s upper face support a pivoting member of the hold bearing part 32.

And, lower ends of the reinforcing boards in the case are approximately same height as the lower face of each main body frame 34*a*, 34*b*.

Right and left end parts of the link connecting member 36*c* also, in the same way as the hold connecting member 36*b*, cut off in the approximately L-shape in a front view, and the link connecting member 36*c* becomes possible to connect with each main body frames 34*a*, 34*b* in two direction of a vertically direction and a horizontally direction, and the link connecting member 36*c* does strength enhancement.

Reinforcing boards also, in the same way as the hold connecting member 36*b*, may be mounted at a rear face of the link connecting member 36*c*, in the case, the reinforcing boards are connected across from a rear face of the hold connecting member 36*b* to the right and left inner faces of the right and left main body frames 34*a*, 34*b*, front faces of the reinforcing boards and the link connecting member 36*c*'s upper face support a pivoting member of the link bearing part 33.

Furthermore, cutouts (scrap clearances) are formed so as not to contact with central upper parts of the reinforcing boards and a central front part of the link connecting member 36*c* in the case, at the time that the above-mentioned link body 5 swings.

The swing stopper connecting member 36*d* is arranged in a direction which the forward and backward length of a rectangular section is longer than other length, and an upper face of the swing stopper connecting member 36*d* is a same height position as the upper face of each main body frame 34*a*, 34*b*, and the upper face of the swing stopper connecting member 36*d* is in flushness with the upper face of each main body frame 34*a*, 34*b*.

The lower face of the swing stopper connecting member 36*d* is arranged at a position to abut on upper faces of the buffer materials 26 of the upper swing stopper part, and the abutting prevents the table shape body 2 from swinging upward by more than a predetermined angle.

Furthermore, a pin, which has a larger diameter shaped head than an axis part in each of right and left symmetrical positions, is held to penetrate from the rear to the front at a middle part in the rightward and leftward direction of the swing stopper connecting member 36*d*.

A support board is provided to support a lower end of the upward urging instrument 7 at a rear and lower part of the main body frame structure 30 of the main body 3. The support board is jointed across the right and left inner face of each main body frame 34*a*, 34*b* and a front face of the upper beam member of the rear leg 35*b*.

Furthermore, a lower face of the support board is in approximately flushness with the lower faces of the right and left main body frames 34*a*, 34*b* and a lower face of the upper beam member of the rear leg 35*b*.

Furthermore, a swing stopper member which regulates a downward swinging of the table shape body 2 may be provided at a rear end's upper part of the main body frame structure 30.

The swing stopper member is, for example, something to arrange a hollow rectangular lumber (a low portion) which the upward and downward length of a rectangular section is longer than other length and a rectangular lumber (a high portion) which a height of the high portion is about double height of the low portion and which a section is approximately square, at an upper face of the upper beam member of the rear leg 35*b* of the main body frame structure 30 in the forward and backward direction side by side, and the swing stopper member is in the approximately L-shape (a stepwise shape) in the side view.

The swing stopper member is covered each of right and left opened outsides by a side face board, and the swing stopper member is elongated the side face board forward and downward by only a predetermined distance, and the swing stopper member puts on right and left outer faces of each main body frame 34*a*, 34*b* from the right and left outsides.

The swing stopper member is fixed on the right and left main body frames 34*a*, 34*b*, according to inserting the fixing tool like a screw et cetera into longholes which is formed at the portion of putting on and which the forward and backward length is longer than other length.

If the fixing position by the fixing tool is closer to the front of the longholes, the buffer materials 26 of the table frame structure 20's rear and lower face abuts on an upper face of the low portion of the swing stopper member, and a downward swinging range of the table shape body 2 becomes wider.

Conversely, if the fixing position is closer to the rear of the longholes, the buffer materials 26 of the table frame structure 20 abuts on an upper face of the high portion of the swing stopper member, and a downward swinging range of the table shape body 2 becomes narrower.

Thus, the swinging range of the table shape body 2 can be changed, owing to the user S, in a case of using the swing stopper member.

Furthermore, the user S can obtain a sense of grounding that "hitting the bottom at the middle of stepping on the stepping surface 2*a*" (for example, an image of a middle running (a middle dash) to run while keeping a predetermined speed), in a case that the swinging range which the swing stopper member permits is shallow (small).

And, the user S can obtain a feeling that "the more stepping on the stepping surface 2*a*, the more sinking, by the sinking, the larger the counterforce", and the user S obtains the rebound form the stepping surface 2*a*, not the user S raises the feet, but the feet of the user S rise (for example, an image of an acceleration running to increase speed gradually), in a case that the swinging range which the swing stopper member permits is deep (large).

The table bearing part 31 of the main body 3 supports the table pivotal axis 21 of the table shape body 2 to rotate freely by a pair of right and left pivoting member which are fixed on the support board 31*a* of the main body frame structure 30's front part.

Furthermore, the pivoting member of the table bearing part 31 and the table pivotal axis 21 are formed in sufficient strength, the raw material and the thickness et cetera to support the body weight of the user S on the table shape body 2 and a reaction of the real motion of stepping on.

And, a pair of right and left pivoting members of the hold bearing part 32 is stood in the upward protruding shape from the main body frame structure 30's upper face at the hold connecting member 36*b* which is in the middle part in the forward and backward direction of the main body frame structure 30 (the approximately one-third position from the front end).

Each pivoting member of the hold bearing part 32 is constituted by a board material which the upward and downward length is longer than other length, and an upper part of each board material is formed in an approximately circular arc shape. A hole for inserting a hold pivotal axis 41 is provided near a center of the circular arc shape portion, a pipe body which has a same inner diameter as a diameter of the hole is provided at the right and left outer face sides of each pivoting member.

A flange is formed downward from a lower end of an outer peripheral face of the pipe body, the flange enhances strength of the pivoting member.

The hold pivotal axis 41 of the hold body 4 is supported to rotate freely at a higher position than the upper face of the main body frame structure 30 (an approximately same height position as the table pivotal axis 21 of the table shape body 2) by the pair of right and left pivoting member like these.

Moreover, a pair of right and left pivoting members of the link bearing part 33 also, like the hold bearing part 32, is stood at the link connecting member 36*c* which is in the middle part in the forward and backward direction of the main body frame structure 30 (the approximately two-third position from the front end), and the standing height is a degree of exceeding the main body frame structure 30's upper face slightly.

Each pivoting member of the link bearing part 33 is constituted by a board material which is the approximately square shape in the side view, and an upper part of each board material is formed in the approximately circular arc shape.

Furthermore, They are same as the hold bearing part 32 that a point which a hole for inserting a link pivotal axis 51 is provided near a center of the circular arc shape portion, and which a pipe body which has a same inner diameter as a diameter of the hole is provided at the right and left outer face sides of each pivoting member, and a point which a flange is formed downward from a lower end of the outer peripheral face of the pipe body, and which the flange enhances strength of the pivoting member.

The link pivotal axis 51 of the link body 5 is supported to rotate freely at a slightly lower position than the upper face of the main body frame structure 30 by the pair of right and left pivoting member like these.

"The Hold Body 4"

As shown in FIGS. 1, 2, the hold body 4 of the 1st embodiment includes not only an abutting portion (a pad body 44 as mentioned below) which supports the user S to abut on the chest region of the user S from the front, if the body weight of the user S is applied, but something to support the abutting portion and something to connect the abutting portion with the main body 3.

Specifically, the hold body 4 comprises a hold frame 40 which is formed in an approximately C-shape in the side view, a hold pivotal axis 41 which pivotally supports to swing freely the hold frame 40 relative to the main body 3, a hold connecting part 42 which is provided at a rear end part of the hold frame 40 and under behind the hold pivotal axis 41 and which connects with the link body 5, a support member 43 which is provided to be elongated further from an upper part of the hold frame 40 and a pad body 44 which is the abutting portion which is mounted through the support member 43. And, the pad body 44 may measure pulsebeats of blood flow of the user S through the abutting place 4*a* on the user S, and the pad body 44 may comprise a sensor which converts measured pulsebeats into heart rates by an operation part.

Furthermore, in the 1st embodiment, a movement ratio varying instrument may be provided at the hold connecting part 42 of the hold body 4, the varying instrument may be provided at the table connecting part 25 of the table shape body 2 side or the link body 5 side, or the varying instrument don't have to be provided.

And, the present invention includes not only a case of constituting the hold body 4 by the pad body 44 to abut on the user S and something whole to support the pad body 44 to swing (to move) freely forward and backward, like the 1st to 3rd embodiments, but also a case of constituting the hold body 4 by the pad body itself, because the pad body which is mounted on the main body 3 through a support bar member 40A to expand and contract freely and a moving body 81 and so on, like the 4th to 8th embodiments as mentioned below.

The hold frame 40 comprises a hold frame lower part 40*a* which is elongated straight forward and upward from between the main body frame structure 30 under the table shape body 2' front part, a hold frame middle part 40*b* which is bent upward further at the hold frame lower part 40*a*'s front end and which is elongated straight and a hold frame middle part 40*b* which is bent at an upper end of the hold frame middle part 40*b* and which is elongated straight backward and upward. Furthermore, the hold frame 40 don't have to be divided into the lower part 40*a*, the middle part 40*b* and the upper part 40*c*, and the hold frame 40 may be integrally formed, a shape of the hold frame 40 may be in an approximately crescent shape which is curved forward in the side view and so on.

And, a hollow portion of the hold frame each part 40*a* to 40*c* is a prism which is communicated each other, a section of the hold frame each part 40*a* to 40*c* is formed in the rectangular shape which the forward and backward length is longer than other length.

Furthermore, a hole for inserting the hold pivotal axis 41 in the rightward and leftward direction is provided at the hold frame lower part 40*a*, and a pipe body which has a same inner diameter as a diameter of the hole is provided at the right and left outer face sides of the hold frame lower part 40*a*. A flange which has a predetermined length is formed forward and upward, and backward and downward along the longer direction of the hold frame lower part 40*a* from the outer peripheral face of the pipe body, the flange enhances strength of the pivoting member.

Furthermore, in a case of using a positioning member as mentioned below, the positioning member comprises the a flange for fixing a positioning member at the hold frame lower part 40*a*'s upper face and just behind the hold pivotal axis 41 and a tongue piece for locking on an upper end part of the positioning member within the flange.

In the case, the flange of the hold frame lower part 40*a* comprises a long and narrow board material which is elongated in the forward and backward direction along the upper face of the hold frame lower part 40*a* and two standing pieces which stand side by side from right and left both end edges of the board material. A hole designed for fixing the positioning member is provided at a lower end of the standing piece.

The tongue piece of the hold frame lower part 40*a* is formed to be elongated forward and upward by a predetermined distance from a middle part in a length direction of the standing piece between two standing pieces of the flange and to be bent like being approximately parallel to the upper face of the hold frame lower part 40*a*.

The hold pivotal axis 41 is mounted to penetrate a middle part in the longer direction of the hold frame lower part 40*a* rightward and leftward, and the hold pivotal axis 41 is pivoted by the hold bearing part 32 which is provide at the hold connecting member 36*b*'s upper face of the middle part in the forward and backward direction of the main body 3.

Consequently, the hold body 4 does a circular movement around the hold pivotal axis 41. Furthermore, the circular movement of the hold body 4 also can be approximated as a linear movement along the forward and backward direction, because a swinging angle of the table shape body 2, in the same way as the table shape body 2, is limited.

The hold connecting part 42 with the link body 5 of the hold body 4 may be used for a movement ratio varying instrument too, we describe in a case of using the movement ratio varying instrument below.

"The Movement Ratio Varying Instrument"

The movement ratio varying instrument is a mechanism which varies a ratio of a distance of the forward and backward swinging of the hold body 4 relative to the upward and downward swinging of the table shape body 2, according to changing a pivotal position of the link body 5 and the hold body 4.

The movement ratio varying instrument comprises a pipe structure which is fixed on a lower end of the hold frame lower part 40*a*, an approximately column shaped rotational member which is fitted in an inner part of the pipe structure to rotate freely and a positioning member which does a positioning of a rotational direction of the rotational member.

The thickness of an axial center direction of the pipe structure of the movement ratio varying instrument is approximately same as the rightward and leftward width of the hold frame lower part 40*a*, the pipe structure is formed in an approximately ring shape.

A fastening hole which penetrates the pipe structure in a radial direction is provided at a portion which is close to the lower face of the hold frame lower part 40*a* of the pipe structure, an engaging piece which protrudes an inner peripheral face of the pipe structure and which is like a set screw et cetera is mounted to protrude and to retract freely.

And, a penetrating hole which a protruding piece, as mentioned below in the positioning member section, penetrates the pipe structure in the radial direction is provided at an upper part of the pipe structure.

The thickness in an axial center direction of the rotational member is approximately same as the rightward and leftward width of the hold frame lower part 40*a*, the rotational member is formed in a disk shape.

An engaging groove which corresponds to the engaging piece to protrude from the inner peripheral face of a lower part of the pipe structure is provided along a peripheral direction at a center in the thickness direction of an outer peripheral face of a lower part of the rotational member.

Consequently, it becomes possible to rotate the rotational member within the pipe structure, without the rightward and leftward position of slipping off, according to engaging with the engaging groove of the rotational member in engaging piece of the pipe structure.

Moreover, an insertion hole for inserting rightward and leftward the hold link connecting axis 53 which connects the link body 5 with the hold body 4 is provided at a position deviated from an axial center of the rotational member.

That is, the hold link connecting axis 53 is "decentering" from the axial center of the rotational member.

Furthermore, the "decentering" means that a distance from the hold link connecting axis 53 to the hold pivotal axis 41 and a distance from the hold link connecting axis 53 to the link pivotal axis 51 are changed (that is, the pivotal position of the link body 5 and the table shape body 2, and/or the link body 5 and the hold body 4 is changed), according to rotating the rotational member.

As a result, even if the table shape body 2 swings by only a same angle, a distance from the connecting axis 53 to each pivotal axis 41, 51 (the swinging angle of the hold body 4) is changed, that is to say, the ratio of the distance of the forward and backward swinging of the hold body 4 relative to the upward and downward swinging of the table shape body 2 is varied, according to "the degree of decentering" of the hold link connecting axis 53.

Three locking pit are provided at an outer peripheral face of an approximately opposite side to the axial center of the rotational member and to the hold link connecting axis 53 decentered.

The three locking pit are arranged with approximately equal intervals along the peripheral direction at a center in an axial center direction (the thickness direction) of the outer peripheral face of the rotational member, the above-mentioned positioning member is capable of locking in the three locking pit.

In FIG. 1, the 1st locking pit of the positioning member is selected, a distance of the forward and backward swinging of the hold body 4 relative to the upward and downward swinging of the table shape body 2 is 100, in a case that the 1st locking pit is selected.

At this time, the distance of the forward and backward swinging of the hold body 4 relative to the upward and downward swinging of the table shape body 2 is 200, in a case that the 2nd locking pit which is ahead the 1st locking pit along the peripheral direction of the rotational member is selected, according to the rotational member of rotating within the pipe structure.

The distance of the forward and backward swinging of the hold body 4 relative to the upward and downward swinging of the table shape body 2 is 300, in a case that the 3rd locking pit which is ahead under the 2nd locking pit along the peripheral direction of the rotational member is selected, according to the rotational member of rotating further within the pipe structure.

The positioning member is a long member which is arranged along the upper face of the hold frame lower part 40*a*, a whole length of the positioning member is slightly shorter than a length from the axial center of the rotational member to the hold pivotal axis 41.

The positioning member comprises a long and narrow board material, a protruding piece which is provided at a lower end part of the board material, a fixing pipe which is provided at a middle part of the board material and a locking hole which is provided at an upper end part of the board material.

The protruding piece of the positioning member is engaged with any of the three locking pits of the rotational member through the penetrating hole of the upper part the pipe structure.

"The degree of decentering" of the rotational member is fixed by the engagement, a distance from the hold link connecting axis 53 to each pivotal axis 41, 51 is changed, it becomes capable of changing the ratio of the distance of the forward and backward swinging of the hold body 4 relative to the upward and downward swinging of the table shape body 2.

The fixing pipe of the positioning member is mounted to direct the axial center of the fixing pipe rightward and leftward at a middle part of a lower face side of the board material, the length in the axial center direction of the fixing pipe is same as the rightward and leftward width of the board material.

The fixing pipe is positioned to insert into the hole designed for fixing of the flange of the hold frame lower part 40*a*, in a case of engaging with the protruding piece of the positioning member with the locking hole.

Consequently, if both the hole designed for fixing and the fixing pipe are fixed by inserting the fixing tool like a screw et cetera, the positioning member is fixed on the hold frame lower part 40*a*.

The locking hole of the positioning member is positioned to be capable of locking on the tongue piece of the hold frame lower part 40*a*, at the same time, the locking hole is formed with a margin of size relative to the tongue piece like the rightward and leftward width of the locking hole of being larger than the rightward and leftward width of the tongue piece and so on.

Consequently, it is possible to swing the whole positioning member upward around a locking place while keeping to lock the locking hole on the tongue piece, it is possible to slip off in the forward and backward direction, and it becomes easy to lock the protruding piece of the positioning member in the locking pits of the rotational member.

Thus, it is possible to vary the ratio of the distance of the forward and backward swinging (movement) of the hold body 4 relative to the upward and downward swinging (movement) of the table shape body 2, owing to a liking of the user 5, in a case of providing the movement ratio varying instrument in the exercise assisting device 1.

And, the variation of the ratio of the distance by the movement ratio varying instrument may do by a driving source like a motor et cetera.

As shown in FIG. 2 specially, the support member 43 of the hold body 4 comprises an approximately Y-shaped pad support part 43*a* which is provided to swing freely around a rightward and leftward axis relative to an upper end of the hold frame upper part 40*c* and an angle adjustment part 43*b* which is provided across between the pad support part 43*a* and the hold frame upper part 40*c*.

The pad support part 43*a* of the hold body 4 is something to be bent right and left symmetrically like two sectional approximately circle shaped pipe members of becoming approximately Y-shape and to support a base part of the approximately Y-shape by the board material from below, a front and lower part of the board material is pivotally supported by the rightward and leftward axis at the upper end of the hold frame upper part 40*c*.

And, the pad support part 43*a* is used for a grip part too, at the time that the user S rides on the table shape body 2, and at the time that the user S takes the forward inclination posture Z.

That is, though the user S is in the state of leaning forward in principle (that is, though the center of gravity G of the user S is positioned forward than the step position F of the user S), the user S can take the forward inclination posture Z without losing a balance, at the time that the user S puts the pad body 44 to the chest region of the user S, in a case of gripping the pad support part 43*a*.

If the angle of the pad body 44 relative to the hold frame upper part 40*c* can be adjust by the angle adjustment part 43*b*, the angle adjustment part 43*b* of the hold body 4 may be any mechanism, for example, the angle adjustment part 43*b* may be provided across between the approximately Y-shaped branching portion of the pad support part 43*a* and a middle part of the hold frame upper part 40*c*. In the case, a distance between the approximately Y-shaped branching portion of the pad support part 43*a* and a middle part of the hold frame upper part 40*c* is selected to be fixed, owing to the body height and the body build et cetera of the user S.

The angle adjustment part 43*b* comprises an inner pipe which is pivotally supported by the rightward and leftward axis at the pad support part 43*a* side, an outer pipe which is capable of inserting the inner pipe and which is pivotally supported by the rightward and leftward axis at the hold frame upper part 40*c* side and a fixing tool for positioning the inner pipe and the outer pipe.

Plural adjusting holes are provided along the length direction at the inner pipe of the angle adjustment part 43*b*, and a fixing hole is provided to fix through the fixing tool at the upper end part of the outer pipe of the angle adjustment part 43*b*.

Consequently, it is capable of changing the height position and the forward and backward position of the pad body 44, it is possible to adjust the various user S, owing to the body size of the user S and a requested forward inclining angle $\alpha$ et cetera, according to appropriately selecting from the plural adjusting holes and to fixing at an angle relative to the hold frame upper part 40*c* of the pad support part 43*a*.

The rightward and leftward width of the pad body 44 of the hold body 4 is small to fit in between both arms of the user S, and the pad body 44 is formed in a shaft shape which is capable of abutting on the chest region of the user S from the front, and the pad body 44 is something to hold the user S in forward inclination posture Z.

The pad body 44 may be constituted by the elastic raw material like the gum et cetera, the pad body 44 may comprise a gelled raw material for absorbing impact and so on at an inner part, and if the body weight of the user S inclining forward is applied, the pad body 44 is recessed sufficiently and supports the user S (the chest region) flexibly.

And, the pad body 44 may be formed in the approximately column shape, a center in the rightward and leftward direction of the abutting surface 44*a* (4*a*) in the case may be in a recessed shape like being along the front face of the trunk T, at the time of not applying the body weight of the user S.

Furthermore, if it is possible to hold the user S inclining forward by the pad body 44, the pad body 44 may be something to abut on only the chest (a chest pad). Besides, the pad body 44 may be something to support the user S to abut on from the abdominal region to the chest region of the user S from the front and something to abut on only the abdominal region (an abdominal pad), and the pad body 44 may support the root joints of both arms of the user S from the armpit to the upper shoulder from the front, within a range of not making trouble in arm swinging et cetera of the user S.

Moreover, in accordance with these, if the user S becomes possible to keep the forward inclination posture Z (the center of gravity G is positioned forward than the step position F of the user S) to topple in principle, without griping with both hands of the user S (that is, the muscles of the periphery of the scapula don't contract excessively, the muscles are in a relaxation state) by holding the trunk T of the user S like covering from the abdominal region to the chest region, both the upper shoulders or both the flanks and supporting from the front support and so on, the pad body 44 may be in any shape.

And, a space between both the shoulders and between both the flanks may be capable of changing, owing to the shape of the body of the user S, in a case that the pad body 44 covers both the shoulders and both the flanks of the user S.

Moreover, a sensor for measuring the pulsebeats of the blood flow of the user S through the abutting place 44*a* on the user S, and converting the measured pulsebeats into the heart rates by a counting circuit may be mounted at the pad body 44.

"The Link Body 5"

As shown in FIG. 1, the link body 5 of the 1st embodiment comprises a link structure 50 which is arranged like the forward and backward length of being longer than other length, a link pivotal axis 51 which pivotally supports a middle part of the link structure 50 at main body 3 to swing freely, a table link connecting axis 52 which connects a rear end of the link structure 50 with the table shape body 2 and a hold link connecting axis 53 which connects a front end of the link structure 50 with the hold body 4.

If the upward and downward swinging (movement) of the table shape body 2 is converted into the forward and backward swinging (movement) of the hold body 4, the link structure 50 may be any constitution, for example, the link structure 50 may comprise two connecting members which connect a pair of rightward and leftward long and narrow link boards with right and left link boards.

In the case, front and rear ends of each of the right and left link boards of the link body 5 is formed in the approximately circular arc shape, and the right and left link boards are clamped both an axis support member which is provided in the downward protruding shape at the table shape body 2 and the hold connecting part 42 of the hold body 4 from the right and left outsides.

A hole for inserting the link pivotal axis 51 which pivotally supports the main body 3 is provided at a middle part of the link board, a pipe body which has a same inner diameter as a diameter of the hole is provided between the right and left link boards.

And right and left outer faces of the two link boards are clamped by the link bearing part 33 (the right and left pivoting members) of the main body 3.

Furthermore, the pipe body is used for the first connecting member in order to connect the right and left link boards too.

An insertion hole for inserting the table link connecting axis 52 which connects the table shape body 2 is provided at a rear part of the link board.

Furthermore, a longhole for inserting the hold link connecting axis 53 which connects the hold body 4 and having the longer direction is provided at a front part of the link board, in a case that the movement ratio varying instrument is provided.

In the case, if the rotational member of the movement ratio varying instrument is rotated, and a distance from the hold link connecting axis 53 to the hold pivotal axis 41 and a distance from the hold link connecting axis 53 to the link pivotal axis 51 are changed, it kept the connecting state which the link body 5 and the hold body 4 are rotated freely in relation to each other, according to the hold link connecting axis 53 of swinging within the longholes of the link boards.

The two connecting members of the link body 5 are the above-mentioned pipe body and a rear connecting member which connects the right and left link board s behind the pipe body.

The rear connecting member is constituted like combining two board materials, a board material which is elongated backward along the longer direction of the link board from a rear peripheral face of the pipe body and a board material orthogonal to the board material and being in an approximately T-shape in the side view.

The approximately T-shape rear connecting member and the pipe body connect the right and left link boards of the link body 5 strongly, at the time that a force of the user S of treading on the table shape body 2 is converted into a force of moving the hold body 4 forward.

"The Upward Urging Instrument 7"

As shown in FIGS. 1, 2, the upward urging instrument 7 of the 1st embodiment is something to resist the user S of stepping on the stepping surface 2*a* of the table shape body 2 and to urge the table shape body 2 upward, for example, the upward urging instrument 7 is constituted by a spring, an air cylinder and an oil cylinder and so on.

The upper end of the upward urging instrument 7 is supported by the rear face of the rear support connecting member 24*c* of the table shape body 2's central part in the forward and backward direction, and the lower end of the upward urging instrument 7 is supported by a support board of the main body 3's rear part, and a pair of the right and left upward urging instruments 7 is arranged at a right and left symmetrical position.

At this point, the urging direction of the upward urging instrument 7 is a forward and upward direction from the support board to the rear support connecting member 24*c*, the upward urging instrument 7 is constituted to be able to sufficiently receive the stepping on at the time that the user S takes the forward inclination posture Z.

That is, it becomes possible to increase the training load too, because the user S steps on the table shape body 2 by a stronger force while resisting an urging force of the urging instrument 7.

Furthermore, the urging force of the upward urging instrument 7 is transmitted as a force to swing the hold body 4 backward through the link body 5.

And, the user S obtains a feeling which the rebound returns a little late from the stepping surface 2*a* relative to stepping on, in a case of using, for example, an air damper as the upward urging instrument 7. the user S obtains the counterforce which the rebound and the response relative to stepping on are quick and which is proportional to a stepping distance (the downward moving distance) of the stepping surface 2*a* from the stepping surface 2*a*, in a case of using a spring as the upward urging instrument 7.

"The Display Part 12"

As shown in FIG. 3, the exercise assisting device 1 of the 1st embodiment may provide a housing 11 and a display part 12 for teaching how to ride the exercise assisting device 1 by sound and/or rhythm pictures, and for inputting the personal data (the attributes) of the user S like the body weight, the distinction of sex and the age et cetera, and for controlling TV viewing and reproducing music and so on, at the hold frame 40 and the support member 43*a* of the hold body 4 as a menu screen of the display part 12 (specially, a left upper schematic view in the FIG. 3).

Furthermore, if it is capable of changing a position of the stepping surface 2*a* of the table shape body 2 and a height of the pad body 44 of the hold body 4 and so on by an electrically powered et cetera, as shown in FIG. 3, the menu screen of the display part 12 may move on to an adjustment screen to adjust the forward, backward, rightward and leftward position and the inclination (the load adjustment) of the stepping surface 2*a* of the table shape body 2 and the height position of the pad body 44 of the hold body 4, owing to the body build and physical strength et cetera of the user S (specially, a right upper schematic view in the FIG. 3).

Furthermore, the display part 12 is constituted by a touch panel (a touch button), it is possible to adjust by inputting a position of the stepping surface 2*a* (a base position), a position of the pad body 44 (a pad position), an inclination of the stepping surface 2*a*, the selection of the real motion like jogging, running and dash et cetera and the time of the real motion, according to manipulating the touch button of the display part 12.

The operation part to compute a value suitable for the user S (a position of the stepping surface 2*a* of the table shape body 2, the height of the pad body 44 of the hold body 4, a forward inclining angle α of the user S itself, and a moving velocity and a moving distance) is built in the housing 11 based on inputted personal data of the user S.

Furthermore, the housing 11 may comprise an USB port to put an USB which is memorized the personal data of the user S into, in the case, the housing 11 may read the personal data from the USB, and the housing 11 may record a total distance and total consumption calories and so on which are computed by the operation part in the USB. Moreover, the housing 11 may comprise a battery charger of a portable telephone and a drink holder.

"The Use Mode"

We explain the use mode of the exercise assisting device 1 of the 1st embodiment.

In the first place, the user S stands on the stepping surface 2*a* of the table shape body 2, and the user S puts the chest on the abutting surface 4*a* of the pad body 44 while gripping the support member 43 et cetera of the hold body 4, and the user S takes the forward inclination posture Z which the center of gravity G is positioned forward than the step position F of the user S.

The user S in the forward inclination posture Z changes the forward and backward position of the stepping surface member 28 of the table shape body 2, the angle of the support member 43 relative to the hold frame 40 of the hold body 4 (the height of the pad body 44) and the ratio of the distance of the forward and backward swinging of the hold body 4 relative to the upward and downward swinging of the table shape body 2 by the varying instrument, if the movement ratio varying instrument is provided, like a proper load in accordance with the body weight and a requested load et cetera.

And, if the driving source and mechanism which do the change automatically is provided, and if a manipulation of the driving source and mechanism can do by display part 12, the personal data (the attributes) of the user S like the body weight, the distinction of sex and the age et cetera are inputted by the touch panel of the display part 12, and a proper forward inclining angle α calculated by the operation part is notified by the display part 12 based on the attributes and a degree of a requested exercise load of the user S (the user S can select from a high load to a low load in stages). The user S fits the forward and backward position of the stepping surface member 28, the height of the pad body 44 and the distance ratio of the upward and downward swinging of the table shape body 2 and the forward and backward swinging of the hold body 4 to an instruction of the user S, according to the user S who see it of manipulating the touch button.

The user S can confirm the degree of inclining forward, according to the user S of adjusting the forward and backward position, the height and the distance ratio in a state which the user S actually takes the forward inclination posture Z.

Furthermore, the forward inclining angle α is set hard, in a case that the user S is the athlete to aim the enhancement of the athletic abilities, and the forward inclining angle α is set shallow, in a case of that the hip joint K is stiff (the movable range of the hip joint K is narrow), and in a case that the purpose is for aged persons and rehabilitation and so on. And, the housing 11 may be mounted to oscillate, and the load of the user S may be relieved, in order to be able to see the display part 12 and to do the manipulation of the touch button in a standing state of the user S too.

Thus, the user S can do the manipulation of the above-mentioned touch panel obviously, and also the muscle of the periphery of the scapula of the user S is in the relaxation state without contracting excessively, because the user S which takes the forward inclination posture Z owing to himself or herself is without griping with both hands of the user S.

Moreover, it becomes easy to obtain the feeling which the pelvis of the user S gets on the knees when the user S steps on by the feet, because the user S becomes possible to keep the forward inclination posture Z to topple in principle.

After that, the user S in the forward inclination posture Z alternatively raises the right and left knees, and the user S swings an opposite side foot to the raised knee downward, and the user S steps on the stepping surface 2*a* of the table shape body 2 (the stepped position at the time becomes the beginning step position F).

The hold body 4 separates from the table shape body 2, and the distance between the table shape body 2 and the hold body 4 is elongated, according to the table shape body 2 of sinking (swinging downward) as stepping on, at the same time, the hold body 4 of swinging forward.

At the time, the forward inclination of the upper body (the trunk T) of the user S is regulated by the hold body 4, moreover, a region to move freely forward and backward in the user 5' body is only a periphery of a pelvis of the user S, because the step position F which the user S steps by the feet doesn't change the beginning step position F.

Consequently, a portion of elongating the distance from the hold body 4 to the table shape body 2 is mainly compensated for only the action of the periphery of the pelvis, that is, the extension of the hip joint K, and the user S (the trunk T) is inclined forward and moves the center of gravity G forward while the user S of stepping on the step position F, which is same as the beginning step position F, of the table shape body 2, and the forward movement of the center of gravity G of the user S is mainly done by the extension of the hip joint K (or, the extension of the hip joint K and the extension of the hip joint H interlock), and the movement of the center of gravity G by the extension of the hip joint K becomes more than the forward movement of the center of gravity G by the forward inclination of the trunk T.

Accordingly, any user S becomes possible to do the extremely close motion to the real motion of running, walking and so on, while the hip joint of the user S of being extent steadily, as it is called, the user S becomes possible to be in a state of using the lower body ("the center of gravity movement while sending the pelvis forward").

Furthermore, the big muscle group the of the periphery of the hip joint K and the muscle group of the femoral region from the hip joint K to the hip joint H are mainly used, and the user S can enhance the training effect of the aerobic exercise by the muscle contraction of the big muscle group.

In addition to this, the user S becomes possible to obtain the touch which is extremely close to the real motion and which the user S goes forward while receiving the counterforce from the table shape body 2, because the user S treads on the table shape body 2 which is a steady foundation and which has the stepping surface 2*a* by the thenar of the user 5, unlike the conventional axle moving type bicycle ergometer.

That is, the user S can do the free action owing to the body build, the muscle strength and the movable range of the joint of each user S and "the center of gravity movement while sending a pelvis forward" at the same time, without an exercise trajectory of the foot of the user S himself or herself of being restrained by pedals et cetera.

Precisely because the action of the foot is free, each user S understands the form at the time of running actually, that is, the real motion (Real Run (registered trademark)). At the same time, it becomes a clue that the user S masters better form (Master Run (registered trademark)).

That is, the user S becomes possible to reverse the right and left feet quickly with good balance in the air, and the user S becomes easy to master a line of the trunk T and the angle of the hip joint K, the knee joints H and the ankles, which are suitable for transmitting the force to a stepping surface 2*a* (ground).

At the same time, the user S obtains the counterforce from the stepping surface 2*a* conversely, according to correctly transmitting the force to the stepping surface 2*a*, naturally the feet of the user S rise forward and high (not the user S raises the feet, but the feet rise), it is easy for the user S to master the ideal form (the run motion, the walk motion) in the relaxation state.

And, the table shape body 2 and the hold body 4 contact with only each pivotal axis of the main body 3, and a contact range of the table shape body 2 and the main body 3, and a contact range of the hold body 4 and the main body 3 become narrow, it can make a loss and sound by friction be small, according to pivotally supporting the table shape body 2 and the hold body 4.

Moreover, if we focus on swinging of the hold body 4, the reaction at the time that the whole hold body 4 moves forward is released in the upward and downward direction and is restrained by the circular movement around pivotal axis, it becomes possible of making the whole exercise assisting device 1 hard to slip off forward.

Furthermore, even if the step position F of the table shape body 2 moves forward and backward, and even if the movable ranges of the hip joints are different from each user S, the movement and the difference are permitted by the portion of the upward and downward swinging of the table shape body 2 and the forward and backward swinging of the hold body 4.

Moreover, owing to the degree that the table shape body 2 moves downward, the exercise assisting device gives the user S the feeling of kicking the hard floor surface and the feeling like running on sandy place and so on, it becomes possible to increase or decrease the load to the user S.

Furthermore, if the stepping on by any of the right and left feet is finished, the user S steps on the table shape body 2 by the opposite side foot, and the table shape body 2 goes back an original upward and downward position, while the user S switches to the opposite side foot.

The user S during training repeats such stepping on in a proper cycle rhythmically rightward and leftward.

And, various informations like the heart rate et cetera by the sensor provided at the hold body 4 are monitored and displayed in real time during training, and also the informations are stored in the memory of the operation part.

After training, a training result like the consumption calories et cetera are displayed on the display part 12.

In the above, though the user S steps by any of the right and left feet, the user S can step on by both right and left feet at the same time.

The 2nd Embodiment

Figure 4:
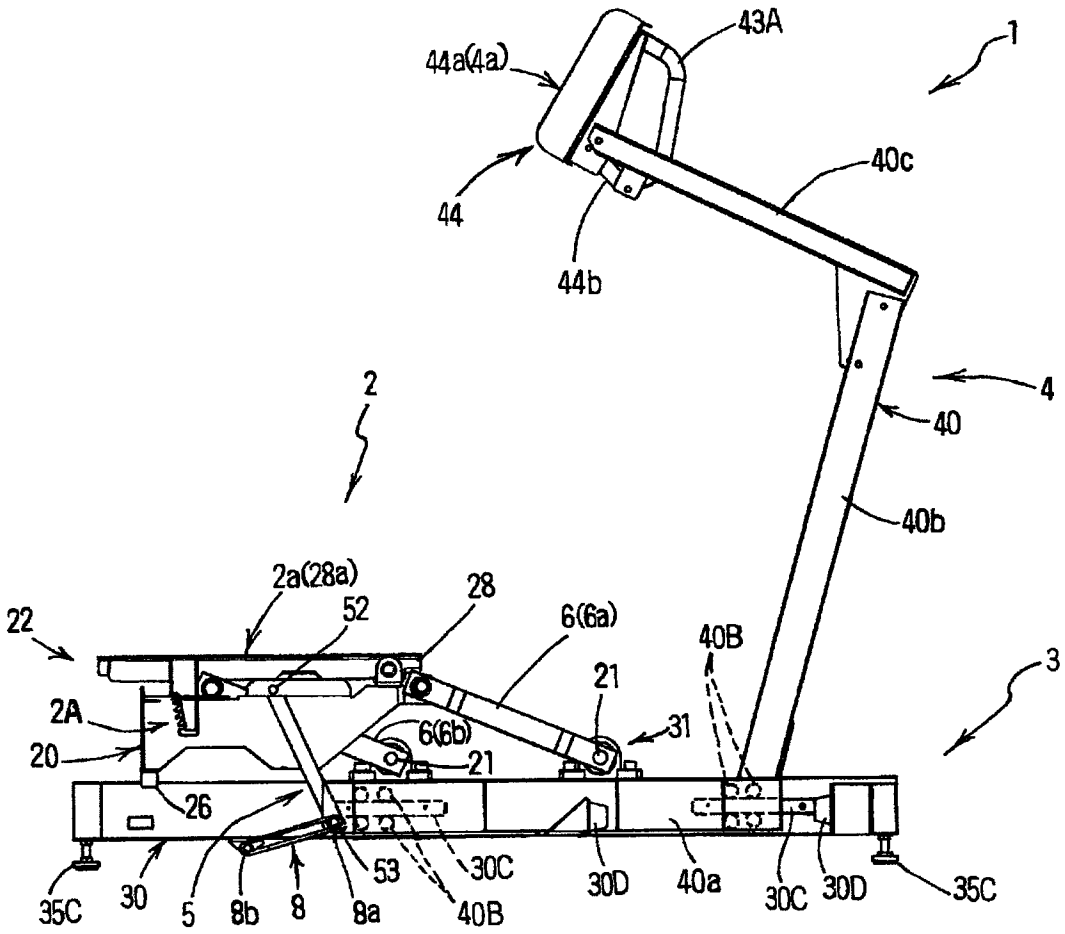
FIG. 4 shows a sectional side view of the exercise assisting device of the 2nd embodiment of the present invention.
Figure 5:
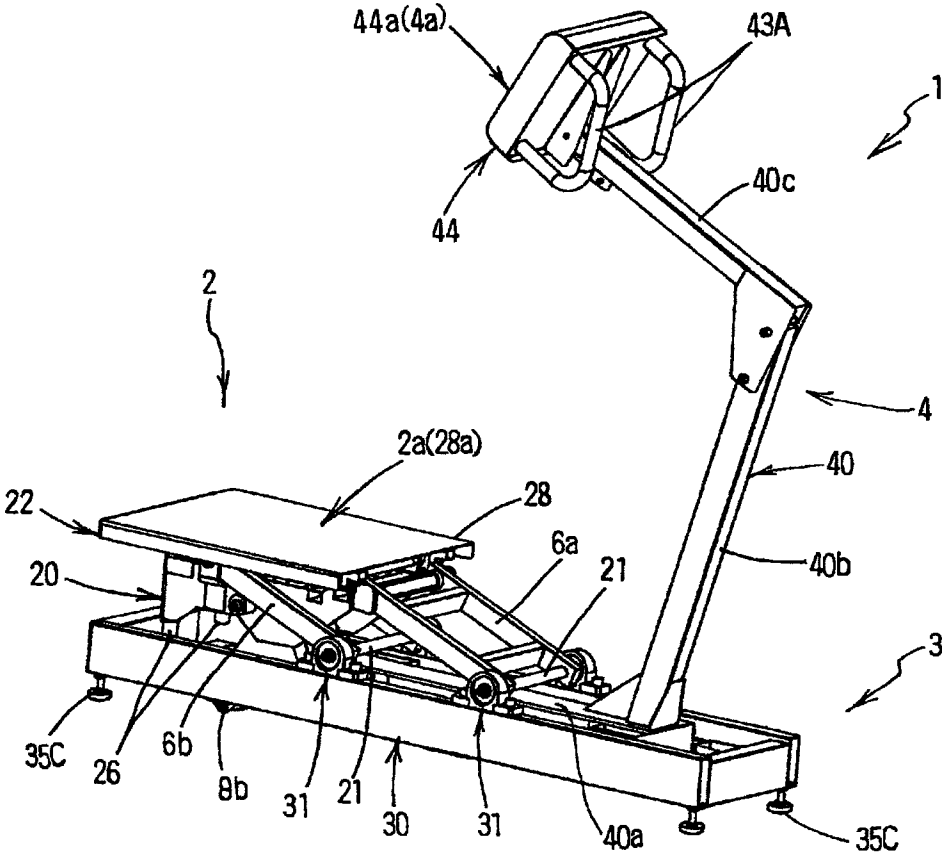
FIG. 5 shows a perspective view of the exercise assisting device of the 2nd embodiment.

In FIGS. 4, 5, the exercise assisting device 1 of the 2nd embodiment of the present invention is shown.

A most different points between the 1st embodiment and the 2nd embodiment are a point which the table shape 2 do not pivotally support, but is connected to move freely upward and downward through a support link 6 relative to the main body 3, and also a point which the hold body 4 also do not pivotally support, but is supported to move straight freely forward and backward through a roller guide relative to the main body 3.

The support link 6 which is the characteristic of the 2nd embodiment comprises right and left front support links 6*a*, 6*a* and right and left rear support links 6*b*, 6*b*, and upper ends of the right and left each front and rear support links 6*a*, 6*b* are pivotally connected at the table shape body 2, and lower ends of the right and left each front and rear support links 6*a*, 6*b* are pivotally connected with the main body 3.

Moreover, the front and rear support links 6*a*, 6*b*, the table shape body 2 and main body 3 constitute in an approximately parallelogram shape in the side view, because lengths of the front support link 6*a* and the rear support link 6*b* are approximately equal, a distance between the upper ends of the front and rear support links 6*a*, 6*b*, and a distance between the lower ends of the front and rear support links 6*a*, 6*b* are also approximately equal.

Consequently, the table shape body 2 swings around axes which pivot the front and rear support links 6*a*, 6*b*'s lower ends, while keeping the angle of the upper face (the stepping surface 2*a*) relative to the main body 3, according to constituting in such parallelogram shape.

Consequently, as shown in FIG. 4, a portion of the movement along the upward and downward direction becomes more in the range that the angle of the front and rear support links 6*a*, 6*b* are less than forty-five degrees from the horizontal, and, if the swinging angle of the front and rear support links 6*a*, 6*b* are small, the movement of the table shape body 2 is approximated as moving obliquely backward and downward.

That is, the table shape body 2 becomes possible to do the movement (the oblique movement) in the upward and downward direction including the forward and backward direction too at the same time, in the 2nd embodiment, the user S becomes easy to obtain the feeling of stepping on, in a case that the direction of the user S of stepping on in the forward inclination posture Z is oblique.

Moreover, it actualizes the oblique movement while keeping the angle of the stepping surface 2*a* of the table shape body 2, in a case of using the two support links 6.

Figure 7:
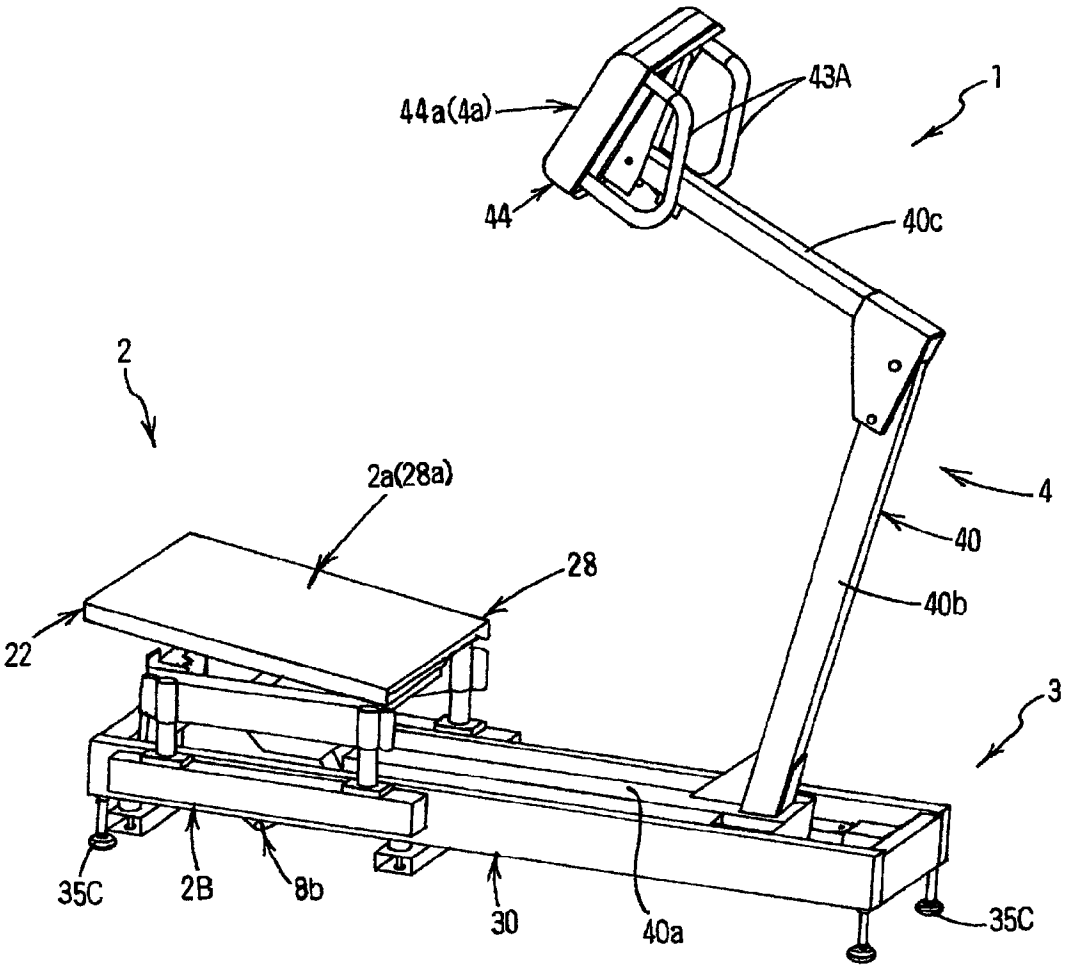
FIG. 7 shows a perspective view of the exercise assisting device of the 3rd embodiment.

Furthermore, an angle changing instrument 2A which adapts the forward inclining angle of the stepping surface 2*a* is provided at the table shape body 2, the angle to be easy step on can be selected owing to the user S (refer to the stepping surface 2*a* in FIG. 7).

And, stoppers which restrain the upward swinging angle to a predetermined value (for example, less than forty-five degrees) are provided at side faces of the table shape body 2.

A pair of right and left linear roller guides 30C is provided along the longer direction of the main body frame structure 30 at right and left inner faces of the main body frame structure 30 of the main body 3 of the 2nd embodiment. The roller guides 30C are engaged with rollers 40B which are provided at the hold frame lower part 40*a* of the hold body 4.

And, an approximately circular truncated cone shaped buffer material 30D is provided in a backward protruding shape from the front inner face of the main body frame structure 30, and a rear face of the buffer material 30D's pointed end is arranged to be capable of abutting on the hold frame lower part 40*a*'s front face, at the time that the hold body 4 moves forward (moves straight forward).

Moreover, the buffer material 30D in a forward protruding shape is provided on a connecting member which connects the right and left main body frames 34*a*, 34*b* and under a pivotally connection position of the front support link 6*a* of the main body frame structure 30.

A rear face of a pointed end of the buffer material 30D is arranged to be capable of abutting on a rear face of the hold frame lower part 40*a*, at the time that the hold body 4 moves backward (moves straight backward).

The rollers 40B are provided at each of right and left outer face of the hold frame lower part 40*a*'s front part and rear part of the hold body 4 of the 2nd embodiment, and the hold body 4 is arranged to move straight freely from the front part to a middle part within the main body frame structure 30, according to the rollers 40B of engaging with the above-mentioned front and rear roller guides 30C of the main body 3.

Furthermore, if the hold body 4 moves straight freely forward and backward, the hold body 4 may be a mechanism to move forward and backward along not the roller guides 30C and the rollers 40B, but a linear rail.

And, the hold frame upper part 40*c* of the hold body 4 is capable of fixing to select an angle freely relative to the hold frame middle part 40*b*, the pad body 44 is mounted to swing freely upward and downward around the rightward and leftward axis relative to the hold frame upper part 40*c*'s upper end.

Furthermore, the pad body 44 is urged in the direction of swinging downward by a urging instrument 44*b* like a spring et cetera, and the pad body 44 is constituted to swing freely forward, while the pad body 44 of resisting the forward inclination of the user S, owing to the degree of inclining forward of the user S. And, a pair of right and left grip parts 43A is provided at a front face side of the pad body 44.

The link body 5 of the 2nd embodiment is constituted by a pair of right and left link boards, upper ends of the link boards are pivotally connected within the table frame structure 20 of the table shape body 2, and lower ends of the link boards are pivotally connected at a rear end of the hold frame lower part 40*a* of the hold body 4.

Consequently, the downward swinging of the table shape body 2 is converted into the forward and backward straight movement of the hold body 4 (the hold frame lower part 40*a*) by the link body 5, and the user S becomes easy to obtain the feeling to do "the center of gravity movement while sending a pelvis forward", because the hold body 4 of supporting the trunk T moves forward at the same time of the user S of stepping on.

An another large different points between the 1st embodiment and the 2nd embodiment is a point which the exercise assisting device 1 comprises not the upward urging instrument 7, a backward urging instrument 8 which urges the hold body 4 backward.

As shown in FIG. 4, the backward urging instrument 8 is constituted by a loop shaped elastic raw material like a gum tube et cetera, and a front end of the backward urging instrument 8 is laid across a front hooking member 8*a* of the hold frame lower part 40*a*'s rear end part of the hold body 4, and a lower end of the backward urging instrument 8 is laid across a rear hooking member 8*b* which connects the right and left main body frames 34*a*, 34*b* at the main body frame structure 30's rear and lower part of the main body 3.

Consequently, the backward urging instrument 8 is drawn, and an urging force works in a direction of bringing back backward relative to the hold body 4, at the time that the hold body 4 moves straight forward.

Thus, the training load can be enhanced, and also a space under the table shape body 2 can be utilized effectively, and the exercise assisting device 1 whole can be miniaturized, because the user S steps on the table shape body 2 by a stronger force while resisting the urging force of the urging instrument 8, according to applying the urging force relative to the hold body 4 by the backward urging instrument 8.

Furthermore, the urging force is transmitted as a force of urging the table shape body 2 upward through the link body 5.

Other constitution, operation and effect and use mode of the exercise assisting device 1 of the 2nd embodiment is same as the 1st embodiment.

The 3rd Embodiment

Figure 6:
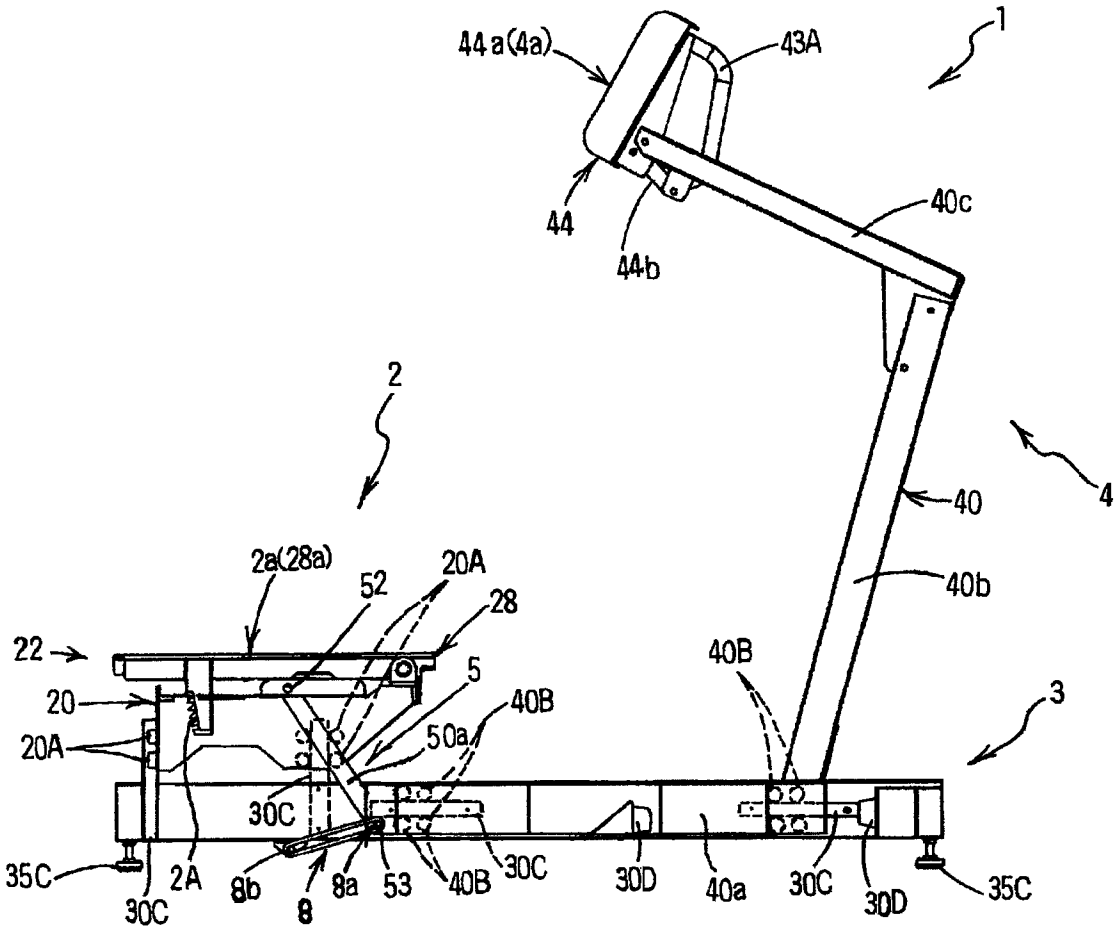
FIG. 6 shows a sectional side view of the exercise assisting device of the 3rd embodiment of the present invention.

In FIGS. 6, 7, the exercise assisting device 1 of the 3rd embodiment of the present invention is shown.

A different point between the 1st, 2nd embodiments and the 3rd embodiment is a point which both the table shape body 2 and the hold body 4 are supported to move straight freely relative to the main body 3 by the roller guide.

A roller 20A is provided at each of right and left outer faces, and a rear face of a middle part in the forward and backward direction of the table frame structure 20 of the table shape body 2 of the 3rd embodiment.

On the other hand, three linear roller guides 30C of engaging with the rollers 20A are provided in a direction which the longer direction detects upward and downward at the main body 3 of the 3rd embodiment.

Two of the three roller guides 30C are arranged at a pair of right and left sides or a rear part of the main body frame structure 30's right and left inner faces, the remaining one of the three roller guides 30C is arranged at the rear inner face of the main body frame structure 30.

Consequently, the table shape body 2 is arranged to move straight freely upward and downward relative to the main body 3, according to engaging with the three roller guides 30C of the main body 3.

That is to say, if both the table shape body 2 and the hold body 4 are supported, for example, along linear roller guides and rails et cetera relative to the main body 3, the main body 3 can stably support the table shape body 2 and the hold body 4 in a wider range.

Furthermore, if the table shape body 2 moves straight freely upward and downward, the exercise assisting device 1 may be a mechanism to move forward and backward along not the rollers 20A and the roller guides 30C, but a linear rail.

FIG. 7 shows that the stepping surface 2*a* (28*a*) of the table shape body 2 of the 3rd embodiment is inclined forward by the angle changing instrument 2A.

And, as shown in FIG. 7, a table auxiliary tool 2B which adapts a backward movement position of the table shape body 2 is provided at the main body frame structure 30's rear part. Other constitution, operation and effect and use mode of the exercise assisting device 1 of the 3rd embodiment is same as the 1st and 2nd embodiments.

The 4th Embodiment

Figure 8:
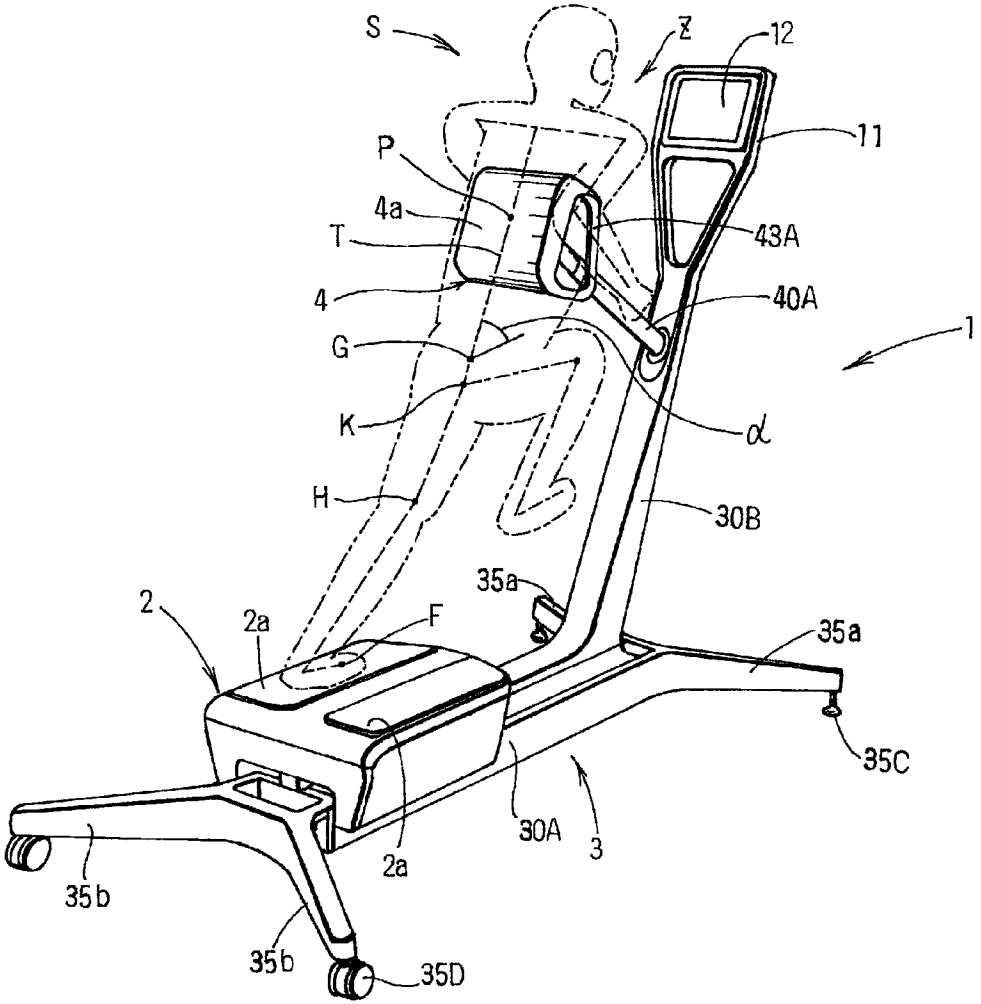
FIG. 8 shows a perspective view of the exercise assisting device of the 4th embodiment of the present invention.

In FIG. 8, the exercise assisting device 1 of the 4th embodiment of the present invention is shown.

The exercise assisting device 1 comprises a table shape body 2 which the user S steps on, a main body 3 which the forward and backward length is longer than other length and supports the table shape body 2 from below and a hold body 4 which are arranged on the main body 3.

The table shape body 2 is in an approximately rectangular parallelepiped shape which a groove is formed at a bottom part of the approximately rectangular parallelepiped shape, and the groove fits like straddling a rear part of the long and narrow main body 3, the table shape body 2 is mounted to move freely upward and downward relative to the main body 3.

And, the upward and downward movement of the table shape body 2 of the present invention means that the table shape body 2 whole moves upward and downward. Furthermore, except for this, the upward and downward movement of the table shape body 2 of the present invention includes that an upper face of the table shape body 2 leans forward (that is, only a front part of the upper face of the table shape body 2 moves downward) and that the upper face of the table shape body 2 leans leftward or rightward (that is, only one of right and left sides of the upper face of the table shape body 2 moves downward).

A stepping surface 2*a* which the user S steps on by the right and left feet is provided at the upper face of the table shape body 2, and non-slip like covering a surface by rubber and so on is applied on the stepping surface 2*a*.

The stepping surface 2*a* has a sufficiently area for the user S of stepping on by the feet, the stepping surface 2*a* is provided at each of the right and left end parts of the table shape body 2's upper face, for the user S to be easy to step on.

Furthermore, the stepping surface 2*a* itself may be mounted to adjust an angle freely relative to the upper face of the table shape body 2, hereby, the user S becomes easy to be directly faced soles of the user S and the stepping surface 2*a* at the time of stepping on, and the user S treads on by the thenar, and the user S can steadily receive the counterforce from the table shape body 2.

And, the table shape body 2 for each of the right and left feet of the user S may be provided separately from each other, in the case, the right and left table shape body 2 can move upward and downward individually.

The main body 3 is placed at the setting surface like a floor, while supporting the above table shape body 2 and the hold body 4 from below. Furthermore, the main body 3 is preferable to be constitute at a low center of gravity, and to do the constitution which has a sense of stabilizing according to having a predetermined weight.

The main body 3, as mentioned above, comprises a body part 30A which is formed in a long and narrow shape which the forward and backward direction becomes longer than other direction, a pair of right and left front legs 35*a*, 35*a* which is provided at a front part of the body part 30A, a pair of right and left rear legs 35*b*, 35*b* which is provided at a rear part of the body part 30A and an upstanding part 30B which is stood at the above front part of the body part 30A.

And, the main body 3 supports the table shape body 2 from below to move freely in the upward and downward direction by an upper face of the rear part of the body part 30A.

Each of the right and left front legs 35*a*, 35*a* is elongated in each rightward and leftward obliquely forward and outward direction from right and left corners of the front end part of the body part 30A of the main body 3. An adjusting screw 35C is provided to adjust a height of the adjusting screw 35C freely at a pointed end of a lower face of each of the front legs 35*a*, 35*a*.

And, each of the right and left rear legs 35*b*, 35*b* is elongated in each rightward and leftward obliquely backward and outward direction from right and left corners of the rear end part of the body part 30A of the main body 3, a caster 35D (a leg wheel) is mounted to oscillate freely at a pointed end of a lower face of each of the rear legs 35*b*, 35*b*.

Furthermore, the caster 35D can prevent oscillating and rolling by stoppers on exercise of the user S.

And, it makes the casters 35D of the rear legs 35*b*, 35*b* capable of oscillating and rolling according to taking off the stoppers at the time of conveying the exercise assisting device 1, and it becomes easy to convey the exercise assisting device 1 according to lifting the front legs 35*a*, 35*a*.

The upstanding part 30B is elongated forward obliquely and upward from the center in the rightward and leftward direction of an upper face of the body part 30A's front end part of the main body 3, and the upstanding part 30B is formed to make a forward and backward thickness thin as extending upward.

A support bar member 40A is elongated backward and upward from a rear face of a middle part in the elongating direction of the upstanding part 30B, and the above hold body 4 is mounted at a pointed end of the support bar member 40A. Furthermore, the support bar member 40A is constituted to expand and contract freely.

Furthermore, the mounting position of the support bar member 40A's base end part may adjust a height of the support bar member 40A freely in accordance with the body height of the user S.

An upper part of the upstanding part 30B joins after bifurcate above the mounting position of the support bar member 40A's base end part, the joining portion forms a flat plate shaped plate part 11. A display part 12 is provided at a surface of the user S side of the plate part 11, the display part 12 is constituted by a touch panel (a touch button).

It becomes possible to input attributes of the user S like the body weight, the distinction of sex and the age et cetera by the display part 12, and, an operation part to compute a value suitable for the user S (an upward and downward moving distance, a moving velocity and a load of the table shape body 2, and a forward and backward moving distance, a moving velocity and a load of the hold body 4 and a forward inclining angle α of the user S itself) is built in the main body 3 (for example, the plate part 11), based on the attributes of the user S.

Furthermore, the user S can change the moving distance of the table shape body 2 and the hold body 4, and the forward inclining angle α of the user S, according to manipulating the touch button of the display part 12.

The rightward and leftward width of the hold body 4 is small to fit in between both arms of the user S, and the hold body 4 is a pad body like a chest pad which has an approximately rectangular abutting surface 4*a* which is capable of abutting on the chest region of the user S from the front, and the hold body 4 is something to hold the user S in forward inclination posture Z.

A cushion body is stuffed into an inner part of the abutting surface 4*a* of the hold body 4, if the user S to incline forward applies the body weight of the user S, the user S (the chest region) is supported flexibly to recess sufficiently. And, an urging instrument like a spring et cetera in order to support the user S flexibly may be built in the support bar member 40A.

Furthermore, if it is possible to hold the user S inclining forward by the hold body 4, the hold body 4 may be something to abut on only the chest. Besides, the hold body 4 may be something to support the user S to abut on from the abdominal region to the chest region of the user S from the front, and the hold body 4 may support the root joints of both arms of the user S from the armpit to the upper shoulder from the front, within a range of not making trouble in arm swinging et cetera of the user S. (Furthermore, the hold body 4 may be something to go around and support the front face of the trunk T of the user S from the rear, in a case of providing the hold body 4 from a ceiling and/or a wall surface as mentioned below.)

Moreover, in accordance with these, if the user S becomes possible to keep the forward inclination posture Z (the center of gravity G is positioned forward than the step position F of the user S) to topple in principle, without griping with both hands of the user S (that is, the muscles of the periphery of the scapula don't contract excessively, the muscles are in a relaxation state) by holding the trunk T of the user S like covering from the abdominal region to the chest region, both the upper shoulders or both the flanks and supporting from the front support and so on, the hold body 4 may be in any shape.

And, a space between both the shoulders and between both the flanks may be capable of changing, owing to the shape of the body of the user S, in a case that the hold body 4 covers both the shoulders and both the flanks of the user S.

Moreover, a sensor for measuring the pulsebeats of the blood flow of the user S through the abutting surface 4*a* on the user 5, and converting the measured pulsebeats into the heart rates by a counting circuit may be mounted at the hold body 4.

And, a grip part 43A which is elongated forward and downward is provided at each of right and left both end parts of the hold body 4's reverse face (front face).

Though the user S is in the state of leaning forward in principle (that is, though the center of gravity G of the user S is positioned forward than the step position F of the user 5), the user S can take the forward inclination posture Z without losing a balance, at the time that the user S puts the hold body 4 to the chest region of the user S, according to gripping the grip part 43A.

Furthermore, the hold body 4 is arranged to move freely forward and backward above the main body 3, because the hold body 4, as mentioned above, is mounted at the pointed end (the upper end) of the support bar member 40A which is expanded and contracted freely and which is elongated from the main body 3.

At this point, the upward and downward movement of the hold body 4 of the present invention includes, of course, that the hold body 4 whole moves upward and downward, and the upward and downward movement of the hold body 4 of the present invention includes that the hold body 4 moves backward and upward along the elongating direction of the support bar member 40A too, and the upward and downward movement of the hold body 4 of the present invention includes that the hold body 4 moves forward and downward along the elongating direction of the support bar member 40A too.

We explain the use mode of the exercise assisting device 1 of the 4th embodiment.

In the first place, the user S stands on the stepping surface 2*a* of the table shape body 2, and the user S puts the chest on the abutting surface 4*a* of the hold body 4 while gripping the grip part 43A of the hold body 4, and the user S takes the forward inclination posture Z which the center of gravity G is positioned forward than the step position F of the user S.

The user S in the forward inclination posture Z inputs the attributes of the user S like the body weight, the distinction of sex and the age et cetera by the touch panel of the display part 12, like a proper load in accordance with the body weight and a requested load et cetera.

A proper forward inclining angle α calculated by the operation part is notified by the display part 12, based on the attributes and a degree of a requested exercise load of the user S (the user S can select from a high load to a low load in stages). The user S fits the forward inclining angle α of the forward inclination posture Z, according to the user S who see it of manipulating the touch button and adjusting a length of the support bar member 40A at the start.

The user S can confirm the degree of inclining forward, according to the user S of adjusting the forward inclining angle α in a state which the user S actually takes the forward inclination posture Z.

Furthermore, the forward inclining angle α is set hard, in a case that the user S is the athlete to aim the enhancement of the athletic abilities, and the forward inclining angle α is set shallow, in a case of that the hip joint K is stiff (the movable range of the hip joint K is narrow), and in a case that the purpose is for aged persons and rehabilitation and so on. And, the display part 12 and the plate part 11 may be mounted to oscillate relative to the upstanding part 30B, and the load of the user S may be relieved, in order to be able to see the display part 12 and to do the manipulation of the touch button in a standing state of the user S too (refer to the 6th embodiment as mentioned below).

Thus, the user S can do the manipulation of the above-mentioned touch panel obviously, and also the muscle of the periphery of the scapula of the user S is in the relaxation state without contracting excessively, because the user S which takes the forward inclination posture Z owing to himself or herself is without griping with both hands of the user S.

Moreover, it becomes easy to obtain the feeling which the pelvis of the user S gets on the knees when the user S steps on by the feet, because the user S becomes possible to keep the forward inclination posture Z to topple in principle.

After that, the user S in the forward inclination posture Z alternatively raises the right and left knees, and the user S swings an opposite side foot to the raised knee downward, and the user S steps on the stepping surface 2*a* of the table shape body 2 (the stepped position at the time becomes the beginning step position F).

The hold body 4 separates from the table shape body 2, and the distance between the table shape body 2 and the hold body 4 is elongated, according to the table shape body 2 of sinking (moving downward) as stepping on.

At the time, the forward inclination of the upper body (the trunk T) of the user S is regulated by the hold body 4, moreover, a region to move freely forward and backward in the user S' body is only a periphery of a pelvis of the user S, because the step position F which the user S steps by the feet doesn't change the beginning step position F.

Consequently, a portion of elongating the distance from the hold body 4 to the table shape body 2 is mainly compensated for only the action of the periphery of the pelvis, that is, the extension of the hip joint K, and the user S (the trunk T) is inclined forward and moves the center of gravity G forward while the user S of stepping on the step position F, which is same as the beginning step position F, of the table shape body 2, and the forward movement of the center of gravity G of the user S is mainly done by the extension of the hip joint K (or, the extension of the hip joint K and the extension of the hip joint H interlock), and the movement of the center of gravity G by the extension of the hip joint K becomes more than the forward movement of the center of gravity G by the forward inclination of the trunk T.

Consequently, any user S becomes possible to do the extremely close motion to the real motion of running, walking and so on, while the hip joint of the user S of being extent steadily, as it is called, the user S becomes possible to be in a state of using the lower body ("the center of gravity movement while sending the pelvis forward").

Furthermore, the big muscle group of the periphery of the hip joint K and the muscle group of the femoral region from the hip joint K to the hip joint H are mainly used, and the user S can enhance the training effect of the aerobic exercise by the muscle contraction of the big muscle group.

In addition to this, the user S becomes possible to obtain the touch which is extremely close to the real motion and which the user S goes forward while receiving the counter-force from the table shape body 2, because the user S treads on the table shape body 2 which is a steady foundation and which has the stepping surface 2*a* by the thenar of the user S, unlike the conventional axle moving type bicycle ergometer.

Furthermore, even if the step position F of the table shape body 2 moves forward and backward, and even if the movable ranges of the hip joints are different from each user S, the movement and the difference are permitted by the portion of the upward and downward movement of the table shape body 2.

Moreover, owing to the degree that the table shape body 2 moves downward, the exercise assisting device gives the user S the feeling of kicking the hard floor surface and the feeling like running on sandy place and so on, it becomes possible to increase or decrease the load to the user S.

This kind of thing may be actualized according to the hold body 4 of moving in the forward and backward direction, instead of the table shape body 2 of moving in the upward and downward direction.

As described in detail, the hold body 4 separates from the table shape body 2 which doesn't change a forward and backward position of the table shape body 2, the distance between the hold body 4 and the table shape body 2 elongates, and the extension of the hip joint mainly compensates the elongation of the distance, and it may make the user S do the running real motion while obtaining the feeling which the pelvis of the user S gets on the knees.

Furthermore, the hold body 4 may move backward, the distance in the upward and downward direction between the hold body 4 and the table shape body 2 elongates, because the backward movement at the time, strictly speaking, means a backward and upward movement along the longer direction of the support bar member 40A.

At the same time, the body (the trunk T) of the user S is raised, that is, the forward inclining angle $\alpha$ becomes shallow, according to the backward and upward movement of the hold body 4, and if the distance in the upward and downward direction between the hold body 4 and the table shape body 2 elongates because of the forward inclination posture Z becomes shallow, the extension of the hip joint is promoted stronger because only the periphery of the pelvis is capable of moving freely forward and backward, and the periphery of the pelvis move excessively forward.

And then, it may become easy to obtain the feeling which the pelvis of the user S gets on knees when the user S steps on by the feet, in a case of extending further the hip joint K because of doing such upward and downward movement of the table shape body 2 and the forward and backward movement of the hold body 4 at the same time Furthermore, if the stepping on by any of the right and left feet is finished, the user S steps on the table shape body 2 by the opposite side foot, and the table shape body 2 goes back an original upward and downward position, while the user S switches to the opposite side foot.

The user S during training repeats such stepping on in a proper cycle rhythmically rightward and leftward.

And, various informations like the heart rate et cetera by the sensor provided at the hold body 4 are monitored and displayed in real time during training, and also the informations are stored in the memory of the operation part.

After training, a training result like the consumption calories et cetera are displayed on the display part 12.

In the above, though the user S steps by any of the right and left feet, the user S can step on by both right and left feet at the same time.

The 5th to 7th Embodiments

Figure 9:
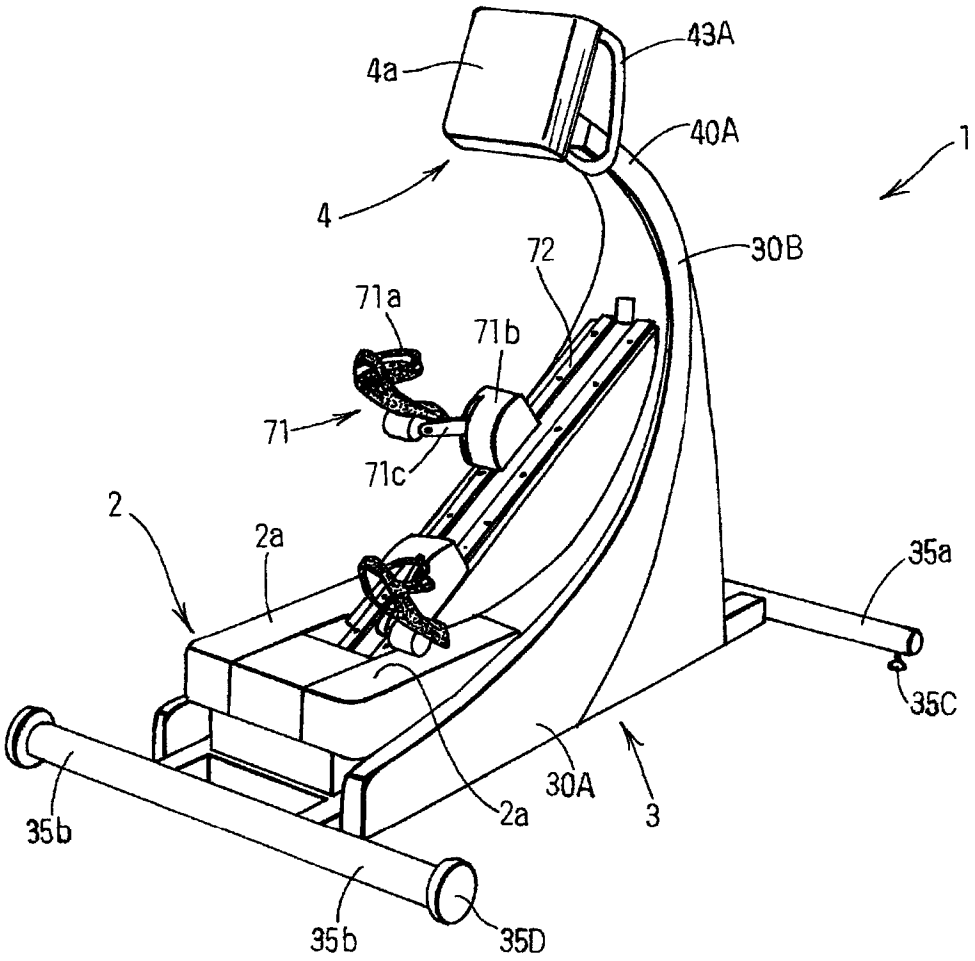
FIG. 9 shows a perspective view of the exercise assisting device of the 5th embodiment of the present invention.
Figure 10:
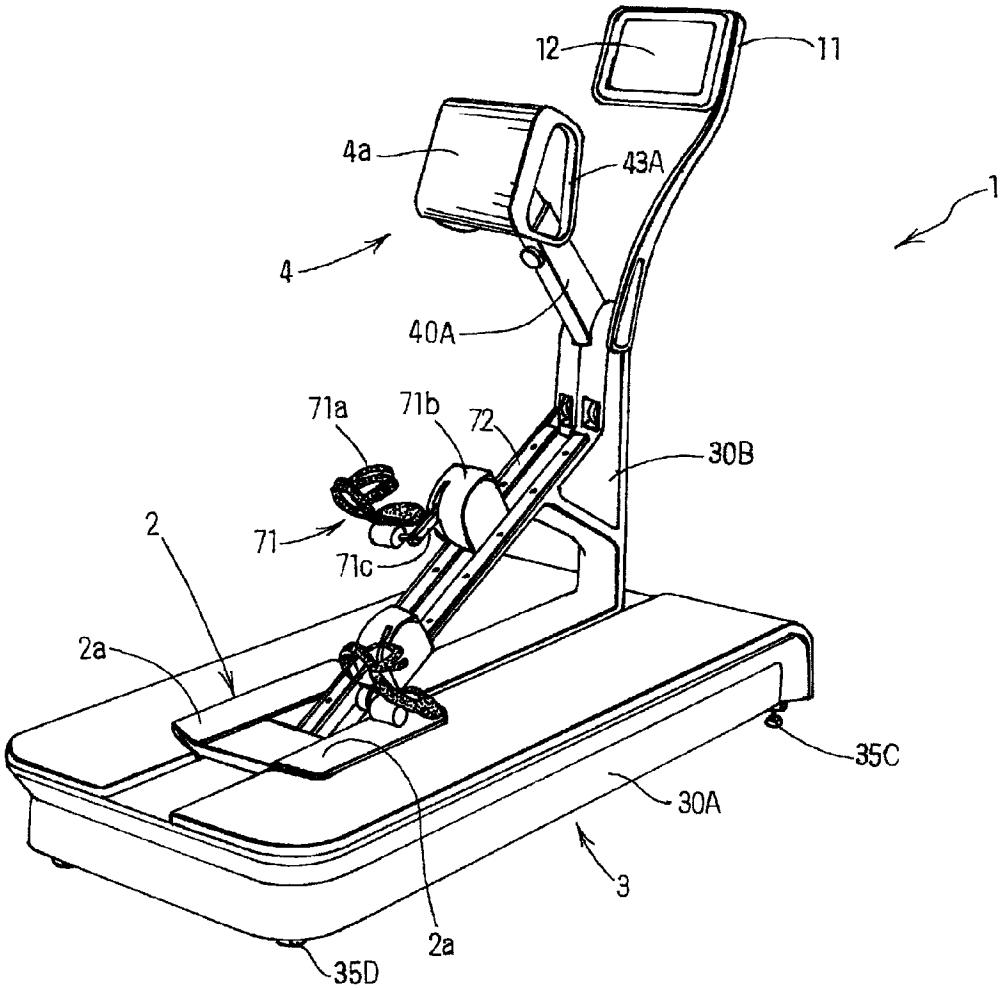
FIG. 10 shows a perspective view of the exercise assisting device of the 6th embodiment of the present invention.
Figure 11:
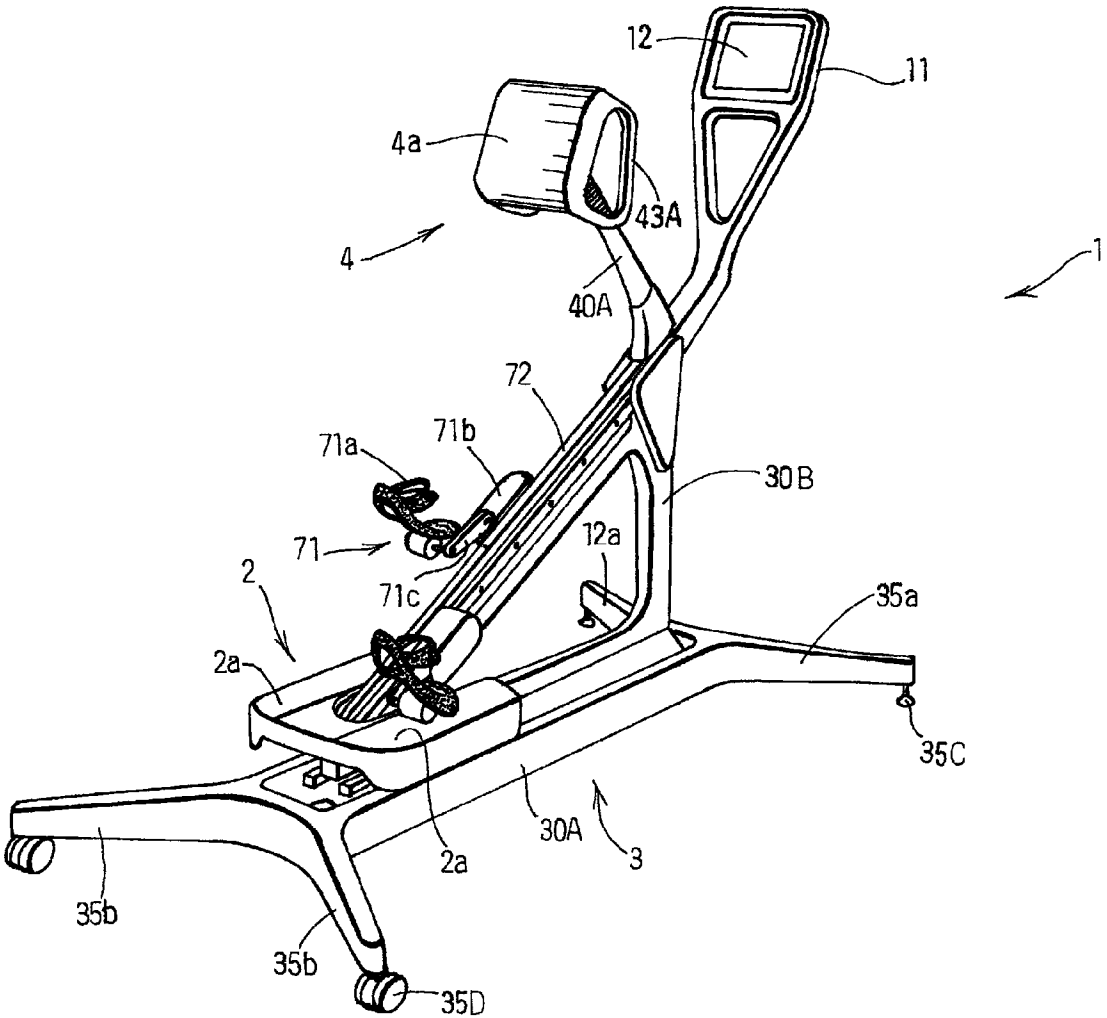
FIG. 11 shows a perspective view of the exercise assisting device of the 7th embodiment of the present invention.

In FIGS. 9 to 11, the exercise assisting device 1 of the 5th to 7th embodiments.

A most different point between the 4th embodiment and the 5th to 7th embodiments is a point which the exercise assisting device is constituted that the user S steps on the table shape body 2 through pedals 71, and the pedals 71 are mounted to move freely along a rail 72 which is elongated forward and upward from the main body 3's rear part to a middle part in upward and downward direction of the upstanding part 30B.

Strap shaped hold parts 71*a* for the feet of the user S of not coming off the pedals at the time of swinging up are mounted at the right and left pedals 71 which the exercise assisting device 1 of the 5th to 7th embodiments comprises, and a box body 71*b* in which builds a member to urge the pedals 71 upward is connected with the pedals 71's reverse face through arms 71*c* which are pivotally supported to swing freely by the box body 71*b*.

The box body 71*b* is engaged to be capable of swinging relative to the right and left rails 72, hereby, the pedals 71 move freely along the longer direction of the rails 72.

And, a relative position of the pedals 71 relative to the box body 71*b* can be changed according to the arms 71*c* of swinging, and an abutting position (the step position F) moves forward and backward at the time that the box body 71*b* moves downward, and when the pedals 71's reverse face abuts on the stepping surface 2*a* of the table shape body 2, according to the change of the relative position.

That is, the step position F can be changed in the forward and backward direction, according to mounting the pedals 71 through the arms 71 to swing freely, even if the exercise assisting device is constituted that the user S steps on the table shape body 2 through pedals 71 to guide the feet of the user S, the user S does a closer motion to the real motion of running et cetera, because the user S can obtain a sense of treading through and the counterforce from the table shape body 2.

Consequently, in the 5th to 7th embodiments too, it becomes possible to make the user S do the big muscle group-centered action with the movement of the center of gravity G, according to regulating the forward inclination of the user S while moving relatively the table shape body 2 and/or the hold body 4 relative to the main body 3, we can enhance the training effect of the aerobic exercises.

Furthermore, the exercise assisting device 1 of the 5th to 7th embodiments may support swinging up of the user S, owing to the physical strength of the user 5, according to pulling up the box body 71*b* by a spindle through a wire and pushing up the box body 71*b* by a driving source like a motor and so on, at the time of the feet of the user S of swinging up, that is, at the time of the box body 71*b* of moving forward and upward along the rails 72. Furthermore, the spindle and the driving source et cetera in the case are built in the main body 3.

Conversely, the exercise assisting device 1 may be constituted to apply a load, according to changing how to use the spindle and the driving source et cetera and providing a breaking instrument like an electro-magnetic brake et cetera at the rails 72, and the user S can select an adjust of the load at will by the touch panel manipulation of the display part 12.

That is, the user S can select the load owing to the distinction of sex, the generation (for example, the youth and the aged) and a purpose of the health promotion, the enhancement of the athletic abilities and the rehabilitation and so on.

Furthermore, such display part 12 and the plate part 11 don't have to be provided (refer to the 5th embodiment in FIG. 9), and, the display part 12 and the plate part 11 may be mounted to swing freely at the middle part in upward and downward direction of the upstanding part 30B (refer to the 6th embodiment in FIG. 10).

Moreover, the body part 30A of the main body 3 may be formed that the rightward and leftward width is wide, and the adjusting screw 35C may be mounted at a lower face of the right and left corner part of the body part 30A's front end, and the caster 35D may be mounted at a lower face of the right and left corner part of the body part 30A's rear end, instead of the right and left front legs 35*a*, 35*a* and rear legs 35*b*, 35*b* (refer to the 6th embodiment in FIG. 10).

And, though the box bodies 71*b* of the 5th, 6th embodiments are mounted to swing freely at an upper face side of the rails 72, the box body 71*b* of the 7th embodiment is mounted to swing freely at right and left outer face sides of the rails 72 (refer to the 7th embodiment in FIG. 11).

Other constitution, operation and effect and use mode of the exercise assisting device 1 of the 5th to 7th embodiments are same as the 4th embodiment.

The 8th Embodiment

Figure 12:
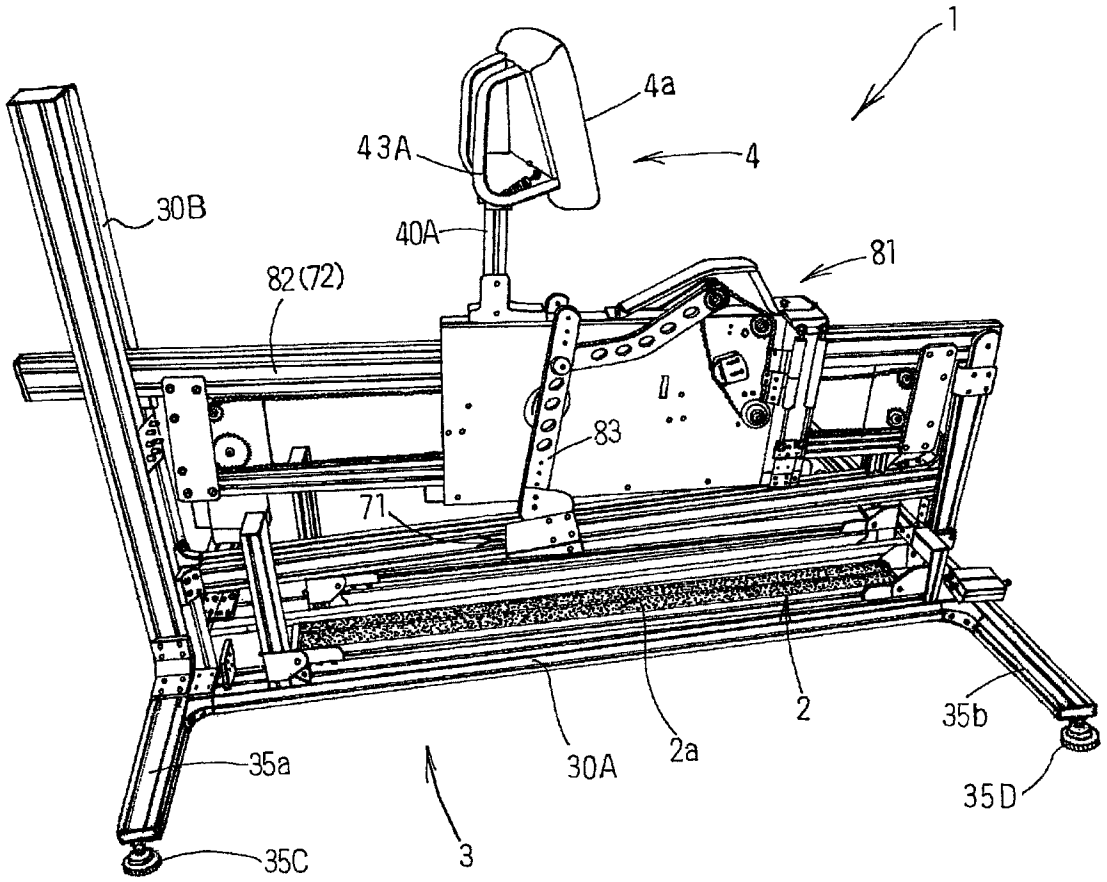
FIG. 12 shows a perspective view of the exercise assisting device of the 8th embodiment of the present invention.

In FIG. 12, the exercise assisting device 1 of the 8th embodiment is shown.

The 8th embodiment is different from the above 4th to 7th embodiments, and the table shape bodies 2 are fixed, instead, a moving body 81 which has the hold body 4 is supported to move freely forward and backward along a rail 82 which is provided at the main body 3.

And, though pedals 71 are provided in the 8th embodiment, a point that the pedals 71 are hanged through links 83 from the moving body 81 is a characteristic too, the user S steps on the table shape bodies 2 through the pedals 71.

Moreover, the exercise assisting device 1 is a constitution that the moving body 81 (the hold body 4) and also the user S himself or herself can go forward actually, because the user S obtains the counterforce, according to stepping on the table shape bodies 2, and the user S's motion is closer to the running real motion.

Furthermore, the 8th embodiment can be said a case of regulating the forward inclination of the user S while the hold body 4 of moving forward, at the time of the forward movement of the center of gravity G of the user S.

The reason is that the center of gravity G is pressed forward by a counterforce from the table shape bodies 2 according to the user S which steps on the table shape bodies 2 over the pedals 71 of stepping on the step position F, and that the moving body 81 is also pressed through the hold body 4 according to the center of gravity G of being pressed, as a result, and the user S is supported by the hold body 4 while the hold body 4 (the moving body 81) of moving forward, and that the degree of inclining forward of the user S is also fixed (that is, is regulated) according to the degree of moving forward of the hold body 4.

In addition to this, in the 8th embodiment, an endless track shaped chain which is laid across the front and the rear under the rail 82 rotates in direction to offset a portion of the forward movement of the moving body 81 (the hold body 4), and the moving body 81 actually stays at an approximately same position, and the moving body 81 don't make trouble in the motion of the user 5, in a case that the table shape bodies 2 and the rails 82 have a predetermined length in the forward and backward direction, at the same time, the moving body 81 comes to front parts of the rails 82.

Conversely, the staying state at the approximately same position is similar to a state which the user S puts into a top speed of the running real motion and a state which the user S do a uniform motion, and a force to go forward actually is almost unnecessary.

And, the rails 82 are mounted to incline an angle freely, and if an inclination of the rails 82 become in a front-rise, a load to apply the user S increases, conversely, if an inclination of the rails 82 become in a front-fall, the load to apply the user S is restrained, and also swinging up and stepping on by the feet of the user S can be supported.

Thus, the user S becomes possible to do a further close motion to the real motion of running and walking and so on, and it can make the user do the trunk-centered action with the center of gravity movement, according to the exercise assisting device 1 of the 8th embodiment which the center of gravity G actually goes forward.

Furthermore, if the rail 82 of the 8th embodiment is in the front-rise, the rail 82 corresponds to the rails 72 which are elongated forward and upward of the 5th to 7th embodiments, and the pedals 71 and also the moving body 81 move freely along the rails 72 (82).

And, in FIG. 12, though the display part 12 and the plate part 11 are provided, obviously, the display part 12 and the plate part 11 may be provided.

Other constitution, operation and effect and use mode of the exercise assisting device 1 of the 8th embodiment is same as the 4th embodiment.

The present invention is not limited the above-mentioned embodiments. Each constitution, whole construction, shape and/or dimension of the exercise assisting device 1 et cetera can change appropriately in accordance with a purport of the present invention.

We described, in the above, (1) a case that the table shape body 2 swings freely, and the hold body 4 also swings freely, (2) a case that the table shape body 2 moves freely through the support link 6, and the hold body 4 moves freely and (3) a case that the table shape body 2 moves straight freely, the hold body 4 also moves straight freely, as mechanisms which the table shape body 2 and the hold body 4 move relative to the main body 3 of the exercise assisting device 1.

That is, if the exercise assisting device 1 regulates the forward inclination of the user S according to the table shape body 2 and/or the hold body 4 of relatively moving relative to the main body 3, the exercise assisting device 1 is not limited to the mechanisms of the above (1) to (3), the mechanism of the exercise assisting device 1 may be any of (4) a ease that the table shape body 2 swings freely, the hold body 4 moves freely through a support link, (5) a case that the table shape body 2 swings freely, the hold body 4 moves straight freely, (6) a case that the table shape body 2 moves freely through a support link, the hold body 4 swings freely, (7) a case that the table shape body 2 moves freely through a support link, the hold body 4 also moves freely through a support link, (8) a case that the table shape body 2 moves straight freely, the hold body 4 swings freely, (9) the table shape body 2 moves straight freely, the hold body 4 moves freely through a support link.

And, in the present invention, "converting the upward and downward movement of the table shape body 2 into the forward and backward movement of the hold body 4" of the link body 5 includes (A) converting the downward movement of the table shape body 2 into the forward movement of the hold body 4 as mentioned above in the 1st to 3rd embodiments. Besides, "converting the upward and downward movement of the table shape body 2 into the forward and backward movement of the hold body 4" of the link body 5 includes at least any one of (B) converting the downward movement of the table shape body 2 into the backward movement of the hold body 4, (C) converting the upward movement of the table shape body 2 into the forward movement of the hold body 4 and (D) converting the upward movement of the table shape body 2 into the upward movement of the hold body 4.

Moreover, if the table shape body 2 and/or the hold body 4 relatively move relative to the main body 3, the exercise assisting device 1 may move each of the table shape body 2 and the hold body 4 by the driving source like a motor et cetera without using the link body 5, and the exercise assisting device 1 may control the relative movement of the table shape body 2 and/or the hold body 4 relative to the main body 3 by a computer et cetera. Besides, the exercise assisting device 1 may move the table shape body 2 and/or the hold body 4 by an air cylinder and a hydraulic cylinder, and the exercise assisting device 1 may control the relative movement relative to the main body 3 by a pneumatic circuit and a hydraulic circuit.

Furthermore, the exercise assisting device 1 may be a mechanism which relatively moves the table shape body 2 and/or the hold body 4 independently, for example, the exercise assisting device 1 may be something to urge each of the table shape body 2 and the hold body 4 by an urging instrument like a spring and an air cylinder et cetera.

The exercise assisting device 1, in the above, comprises any of the upward urging instrument 7 and the backward urging instrument 8, the exercise assisting device 1 may comprise both the upward urging instrument 7 and the backward urging instrument 8, and the exercise assisting device 1 don't have to comprise any of the urging instruments 7, 8.

The exercise assisting device 1 supports the hold body 4 by the upstanding part 30B which is elongated upward from the main body 3, and if the hold body 4 can hold the trunk T of the user S who steps on the table shape body 2 and whose the center of gravity G is positioned forward than the step position F of the user S, like the hold body 4 of hanging down from a ceiling of a building, and like the hold body 4 of elongating from a wall surface near a placing location of the main body 3 and providing and so on, the exercise assisting device 1 may be any of mode.

If the table shape body 2 and/or the hold body 4 relatively move relative to the main body 3, the table shape body 2 and/or the hold body 4 may move any direction, and the table shape body 2 may move backward and downward along a direction of the forward inclining angle $\alpha$ of the user S which is detect (that is, an axis line of the trunk T of the user S in the forward inclination posture Z), furthermore, the exercise assisting device 1 may expand and contract the support bar member 40A while directing the longer direction of the support bar member 40A of the hold body 4 to a direction orthogonal to the direction of the forward inclining angle $\alpha$, the hold body 4 may move forward and upward, and backward and downward along an approximately direction of the forward inclining angle $\alpha$. The hold body 4 and the support bar member 40A, and the support bar member 40A and the upstanding part 30B may be mounted through a ball joint and may swing freely with each other for such movement.

The upward and downward movement of the table shape body 2, and the forward and backward movement of the hold body 4 may do by any of the urging instrument like a spring and an air cylinder et cetera, a link mechanism which releases a portion of the upward and downward movement to the forward and backward direction and the driving source like a motor et cetera.

We describe the step position F of the table shape body 2, a position which the held user S steps on at the time of moving the center of gravity G forward is same as the beginning step position F, and the pelvis gets on the knees according to regulating the forward inclination of the user S by the relative movement of the table shape body 2 and/or the hold body 4 because of not changing the step position F, and if the hold body 4 steadily holds the user S in a state of leaning forward, a hold position P which the hold body 4 holds the user S may slip off slightly.

The above adjusting screw 35C may be mounted at the pointed ends of the rear legs 35*b*, 35*b* of the main body 3, instead of the caster 35D, and if the exercise assisting device 1 is placed steadily in the setting surface when the user S uses, the exercise assisting device 1 may be any of constitution which mounts nothing like the adjusting screw 35C and the caster 35D and so on.

And, the sensor of the hold body 4 may be something to able to measure the body fat percentage of the user S by only abutting during training.

Moreover, though the hold body 4 is mounted at the upstanding part 30B of the main body 3 through the support bar member 40A, if the hold body 4 can do the above-mentioned hold of the user S and the forward and backward movement et cetera, the hold body 4 may be mounted directly at the upstanding part 30B et cetera without the support bar member 40A.

And, handrails which the user S grips may be provided separately from the hold body 4.

The upward urging instrument 7 may be a constitution to become that the more downward the table shape body 2 is located, the stronger a force to urge the table shape body 2 upward is, at the time that the user S steps on the stepping surface 2*a* and the table shape body 2 does the downward movement, for example, the upward urging instrument 7 may be constituted that two springs of different lengths are arranged concentrically, and that only one spring urges the table shape body 2 upward until the table shape body 2 moves by a predetermined downward position from starting the downward movement, and the two springs urge the table shape body 2 upward at the time that the table shape body 2 moves further downward from the predetermined downward position.

If the upward urging instrument 7 is such constitution, an upward urging force which only one spring exerts is sufficient in a case that the users S are children and elderly persons et cetera, and a sufficient training load can be given to the user S, in a case that the users S are athletes to aim the enhancement of the athletic abilities, because the athletes step on deeply, the two springs exert the upward urging force, and the construction of the upward urging instrument 7 can be simplified and the weight of the upward urging instrument 7 can be saved, because the user S can switch the urging force owing to the user S without switching trouble and a mechanism to switch the urging force becomes unnecessary.

Furthermore, the upward urging instrument 7 may be constituted by a computer et cetera, in a case that the table shape body 2 moves by the driving source like a motor et cetera, an air cylinder and a hydraulic cylinder, and the upward urging instrument 7 may be constituted according to controlling to decrease a downward moving velocity and to decrease a ratio of the backward movement of the table shape body 2 relative to the user S of stepping on, in a case that the table shape body 2 move further downward from the predetermined downward position.

And, the backward urging instrument 8 is also provided a constitution to the urging force owing to such moving distance.

EXPLANATION OF NUMERALS AND SYMBOLS

1 exercise assisting device
2 table shape body
3 main body
4 hold body
5 link body
6 support link
7 upward urging instrument
8 backward urging instrument
71 pedal
72 rail
S user
F step position of user
G center of gravity of user
T trunk of user

What is claimed is:

1. An exercise assisting device comprising:
a table shape body configured for a user to step on;
a main body which supports the table shape body from below; and
a hold body which is arranged on the main body, wherein the hold body comprises an abutting portion configured to hold the user by abutting a front of a trunk of the user as the user steps on a step position provided on an upper surface of the table shape body such that a center of gravity of the user is positioned more forward than the step position of the table shape body, wherein the exercise assisting device is configured to move the table shape body upward and downward relative to the main body and move the hold body forward and backward relative to the main body while regulating a forward inclination of the user, and wherein the abutting portion of the hold body is capable of being positioned a vertical distance directly over the upper surface of the table shape body.

2. The exercise assisting device according to claim 1, wherein
the table shape body is pivotally supported to swing freely upward and downward relative to the main body,
the hold body is pivotally supported to swing freely forward and backward relative to the main body, and
the exercise assisting device converts the upward and downward swinging of the table shape body into the forward and backward swinging of the hold body and regulates the forward inclination of the user.

3. The exercise assisting device according to claim 2, wherein the exercise assisting device converts the upward and downward swinging of the table shape body into the forward and backward swinging of the hold body by a link body which pivotally connects the table shape body and the hold body, said link body being pivotally supported to swing freely relative to the main body.

4. The exercise assisting device according to claim 3, wherein
the exercise assisting device comprises at least one of: an upward urging instrument which urges the table shape body upward; and a backward urging instrument which urges the hold body backward.

5. The exercise assisting device according to claim 2, wherein
the exercise assisting device comprises at least one of: an upward urging instrument which urges the table shape body upward; and a backward urging instrument which urges the hold body backward.

6. The exercise assisting device according to claim 1, wherein
the exercise assisting device comprises at least one of: an upward urging instrument which urges the table shape body upward; and a backward urging instrument which urges the hold body backward.

7. The exercise assisting device according to claim 1, wherein the exercise assisting device is configured to move the table shape body upward and downward relative to the main body and move the hold body forward and backward relative to the main body.

* * * * *